US012140391B2

(12) United States Patent
Olsen

(10) Patent No.: US 12,140,391 B2
(45) Date of Patent: Nov. 12, 2024

(54) SUPPRESSOR SYSTEMS AND APPARATUSES FOR FIREARMS

(71) Applicant: Killer Innovations, Inc., Tumwater, WA (US)

(72) Inventor: Richard Brady Olsen, Rainier, WA (US)

(73) Assignee: Killer Innovations, Inc., Tumwater, WA (US)

( * ) Notice: Subject to any disclaimer, the term of this patent is extended or adjusted under 35 U.S.C. 154(b) by 0 days.

(21) Appl. No.: 18/152,675

(22) Filed: Jan. 10, 2023

(65) Prior Publication Data

US 2023/0221088 A1 Jul. 13, 2023

Related U.S. Application Data

(60) Provisional application No. 63/266,665, filed on Jan. 11, 2022.

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS

| | | | | |
|---|---|---|---|---|
| 8,272,306 | B1 * | 9/2012 | Smith | F41A 21/30 89/14.4 |
| 8,387,299 | B1 * | 3/2013 | Brittingham | F41A 21/30 89/14.4 |
| 9,746,267 | B2 * | 8/2017 | Smith | F41A 21/30 |
| 10,281,228 | B1 * | 5/2019 | Marfione | F41A 21/30 |
| 2011/0088540 | A1 * | 4/2011 | Brittingham | F41A 21/26 89/14.5 |
| 2018/0120045 | A1 * | 5/2018 | Röst | F41A 21/36 |
| 2020/0232740 | A1 * | 7/2020 | Honigmann | F41A 21/30 |

* cited by examiner

*Primary Examiner* — Gabriel J. Klein
(74) *Attorney, Agent, or Firm* — Eversheds Sutherland (US) LLP

(57) ABSTRACT

Suppressor systems and apparatuses for use with firearms are provided. A suppressor includes a core, a main can, and a spring. The core defines a first channel that intersects a radially dispersed hole configuration and is configured to be coupled to a firearm. The main can is disposed around the core and includes a baffle structure. The baffle structure includes a plurality of baffles that define a second channel and a plurality of chambers intersecting the second channel. In various configurations, the core and/or the main are either a unitary piece or each formed from a plurality of components. The spring is configured to axially bias the main can with respect to the core, thereby providing for a valve action that controls a flow of a volume of gas produced by a discharge of the firearm.

20 Claims, 15 Drawing Sheets

SUPPRESSOR SYSTEMS AND APPARATUSES FOR FIREARMS

CROSS-REFERENCE TO RELATED APPLICATION

This application is related to, and claims the benefit of, U.S. Provisional Patent Application No. 63/266,665, filed Jan. 11, 2022, the entire contents of which are incorporated herein by reference.

TECHNICAL FIELD

The present application generally relates to suppressor systems.

BACKGROUND

A discharge of a firearm generates substantial noise and recoil, which may prove harmful and disruptive to a user of the firearm. For example, the discharge of the firearm may propel a volume of gas through a barrel of the firearm at a high speed, while simultaneously generating inertial recoil. If the volume of gas is allowed to exit the barrel of the firearm at an uninhibited velocity, the egress may further generate a loud noise, in a similar manner to that produced by the popping of a balloon. Were the volume of gas forced to decrease its velocity before exiting into an external environment, the noise produced by the discharge of the firearm would be effectively dampened, in a manner instead akin to releasing air slowly from a balloon.

As such, it is desirable to control the flow of a volume of gas produced by the discharge of a firearm, thereby dampening noise and/or reducing recoil. Suppressors have been used to provide limited means of flow control following the discharge of firearms. However, there is a need for improved metering of the flow of gas produced by the discharge of firearms.

BRIEF DESCRIPTION OF THE DRAWINGS

These and other features, aspects, and advantages of the present invention will become apparent from the following description, the appended claims, and the accompanying exemplary embodiments shown in the drawings, which are briefly described below:

DETAILED DESCRIPTION

Figure 1:
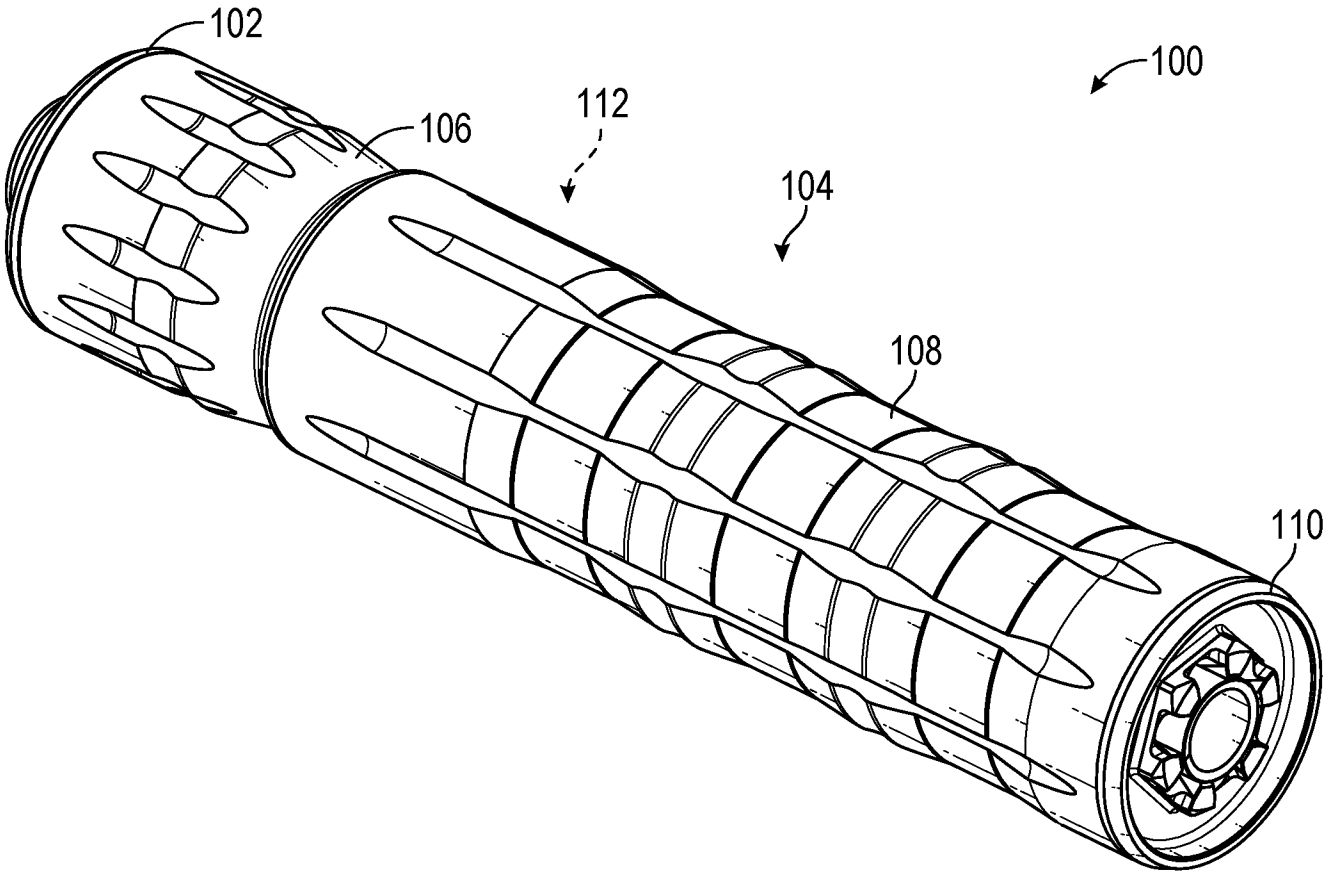
FIG. 1 is a perspective view of a suppressor in accordance with one or more exemplary embodiments of the disclosure.

The present disclosure provides for suppressor systems and apparatuses. A suppressor may include a core, a main can, and a spring. The core may define a first channel that intersects a radially dispersed hole configuration and may be configured to be coupled to a firearm. The main can be disposed around the core and include a baffle structure. The baffle structure may include a plurality of baffles that define a second channel and a plurality of chambers intersecting the second channel. In various configurations, the core and/or the main can each be a unitary piece or be formed from a plurality of components.

The spring may be coupled to the core and configured to axially bias the main can, responsive to a discharge of the firearm, between at least a first position and a second position with respect to the core. The spring may be selected, altered, or installed based on a desired compressive force that the spring is to exert with respect to one or more components of the suppressor with which it engages, thereby providing for adjustment of the axial biasing operation. The first position and the second position may, respectively, define a first pathway and a second pathway between the first channel, the second channel, and/or the plurality of chambers via the hole configuration. The suppressor may be configured to control a flow of a volume of gas, produced by the discharge of the firearm, via the first pathway or the second pathway based on whether the main can is axially biased in the first position or the second position with respect to the core. As described in further detail below, the suppressor may thereby facilitate a valve action between the core and the main can that controls the flow of the volume of gas produced by the discharge of the firearm.

The firearm with which the suppressor is configured for use may be any suitable firearm. For example, the suppressor may be configured for use with a handgun, a long gun, a shotgun, or any other type of firearm compatible with any caliber of rounds of ammunition. Moreover, the suppressor may be configured for use with a blowback-operated firearm, a gas-operated firearm, a recoil-operated firearm, or a firearm capable of any other type of operational cycling. The type of firearm, intended caliber, and type of operational cycling with which the suppressor is intended for use may further inform the particular configuration and functionality of the suppressor.

Accordingly, various sources of energy associated with the discharge of the firearm may facilitate the axial biasing and/or opposed motion of the main can and the core with respect to one another. For example, in some embodiments, the spring may be configured to axially bias the main can with respect to the core responsive, at least in part, to a recoil produced by the discharge of the firearm. In other embodiments, the spring may be configured to axially bias the main can with respect to the core responsive, at least in part, to a change in gaseous pressure produced by the discharge of the firearm.

Moreover, depending on the desired performance characteristics of the suppressor, its various components may be formed from any suitable material. For example, one or more component(s) of the suppressor may be formed from metal (e.g., titanium, steel, stainless steel, and/or aluminum), rubber, plastic, another composite material, or any other suitable material. It will, of course, be understood by those having skill in the art that one or more material(s) may be selected or substituted depending on the applicable configuration of the suppressor and/or the firearm with which the suppressor is to be used, such alternative embodiments being envisioned by the present disclosure.

In various embodiments, the suppressor may provide numerous benefits associated with the discharge of the firearm by, for example, metering the flow of the volume of gas produced by the discharge of the firearm. For one, by lessening a speed with which the volume of gas escapes from a muzzle end of the firearm and/or the suppressor, the suppressor may dampen a sound generated by the discharge of the firearm. In addition or alternatively, the suppressor may lessen a recoil produced by the discharge of the firearm. In these and other manners, the suppressor may thereby provide for improved performance of the firearm.

Figure 2:
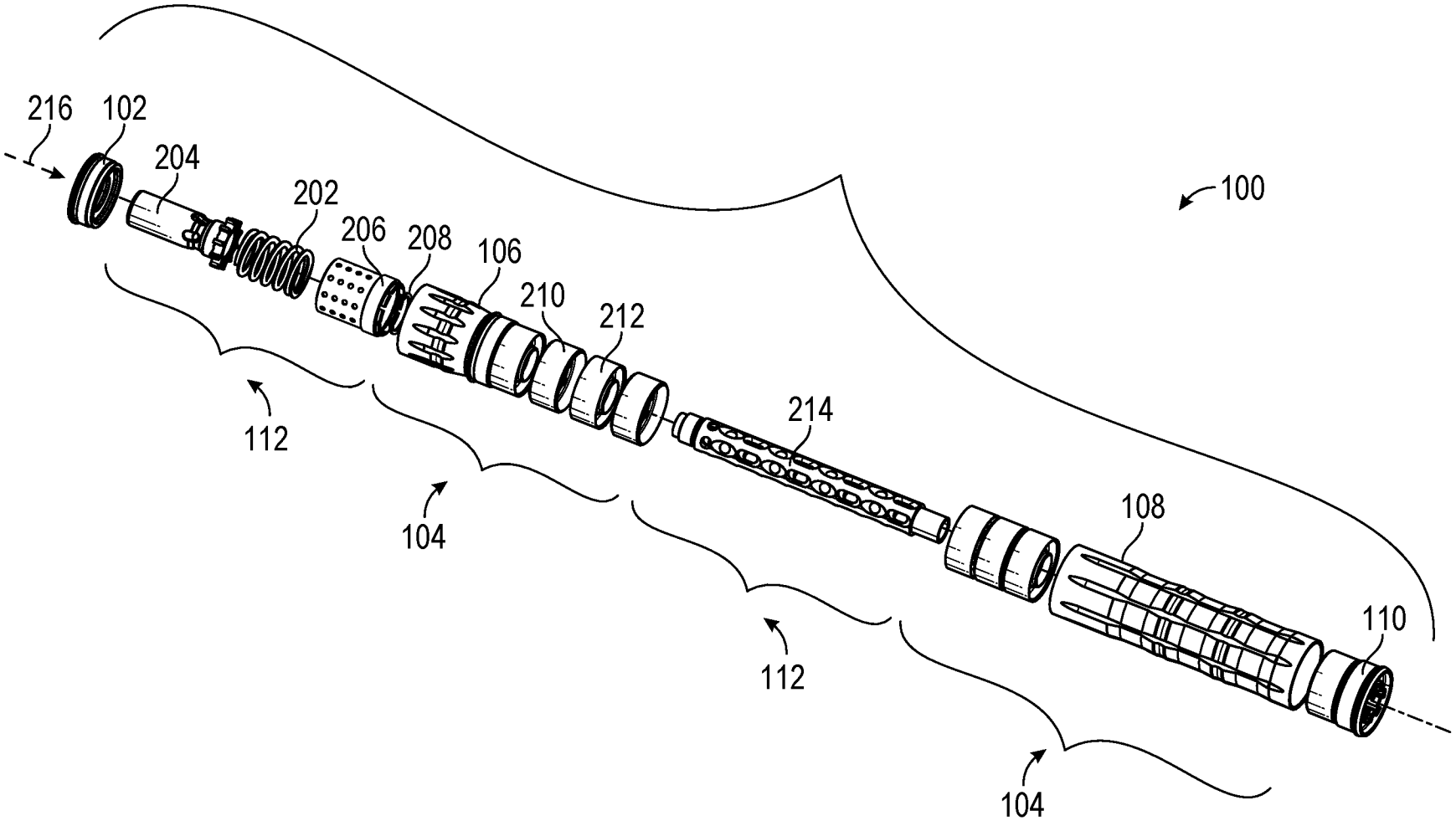
FIG. 2 is an exploded view of a suppressor in accordance with one or more exemplary embodiments of the disclosure.

Referring now to FIGS. 1-2, and in brief overview, suppressor 100 may include mounting cap 102, main can 104, core 112, and/or discharge cap 110. As shown in FIG. 1, the mounting cap 102 may be disposed within and/or mated to the main can 104. The discharge cap 110 may be rigidly coupled to the main can 104. The main can 104 may include boost housing 106 and/or main housing 108. In some embodiments, the main can 104 may be formed from a unitary piece, which may define the boost housing 106 and the main housing 108. In other embodiments, the boost housing 106 and the main housing 108 may be separable components of the main can 104 that are configured to be rigidly coupled to each other.

The suppressor 100 may be configured for use with a firearm. The suppressor 100 may have a substantially cylindrical profile defining a longitudinal axis that corresponds to a longitudinal axis of a barrel of the firearm. In various embodiments, the suppressor 100 may be rigidly coupled to the firearm at a proximal end of the suppressor 100 nearest the mounting cap 102 (as opposed to a distal end of the suppressor 100 nearest the discharge cap 110). Accordingly, the barrel of the firearm and the suppressor may define a channel extending from the barrel of the firearm, through an internal volume of the suppressor 110, and terminating about the discharge cap 110.

As shown in FIG. 2, the suppressor 100 may include the mounting cap 102, spring 202, boost core 204, boost sleeve 206, one or more O-ring(s) or gasket(s) 208, the boost housing 106, one or more first baffle(s) 210, one or more second baffle(s) 212, valve core 214, the main housing 108, and the discharge cap 110. In various embodiments, one or more of the aforementioned component(s) may include cylindrical profiles, apertures, bores, channels, and/or holes that, when such components are coupled or mated to one another, may be oriented in a concentric or substantially concentric configuration such that channel 216 is defined. As previously discussed with respect to FIG. 1, the suppressor 100 may have a substantially cylindrical profile defining a longitudinal axis. The longitudinal axis defined by the substantially cylindrical profile of the suppressor may correspond to a longitudinal axis of the channel 216.

In various embodiments, the mounting cap 102 may be disposed around and rigidly coupled to the boost core 204. The boost sleeve 206 may be disposed around and engaged with the boost core 204. The spring 202 may be disposed between the boost core 204 and the boost sleeve and/or engaged against one or more radial extrusion(s) of the boost core 204 (such as radial extrusion(s) 408 illustrated in FIGS. 4A-4B and further described below). Although the present embodiment illustrates the spring 202 in an exploded view disposed between the boost core 204 and the boost sleeve 206 to illustrate that the spring 202 may fit within the boost sleeve 206, it should be understood that the spring 202 may be installed about the boost core 204 from an end of the boost core 204 closer to the mounting cap 102. In some embodiments, the spring 202 may be engaged between the mounting cap 102 and the radial extrusion(s) of the boost core 204. The boost sleeve 206 may be further disposed within and/or coupled to the mounting cap 102. The valve core 214 may be rigidly coupled to the boost core 204. The boost core 204, the boost sleeve 206, and/or the valve core 214 may form, in whole or in part, the aforementioned core 112 of the suppressor 100.

The boost core 204, the boost sleeve 206, and/or the valve core 214 may define one or more channel(s) intersecting one or more set(s) of radially disposed holes. For example, the boost core 204 may define channel 414 intersecting one or more hole(s) 410 (illustrated in FIGS. 4A-4B and further described below), the boost sleeve 206 may define channel 512 intersecting one or more hole(s) 506 (illustrated in FIGS. 5A-5B and further described below), and/or the valve core 214 may define channel 916 intersecting one or more hole(s) 902 and/or one or more hole(s) 904 (illustrated in FIGS. 9A-9B and further described below). In combination, the one or more channel(s) may form one or more longer channel(s). For example, the channel 414 of the boost core 204 and the channel 916 of the valve core 214 may form a unitary channel disposed, at least in part, within the channel 512 of the boost sleeve 206. This unitary channel may, in turn, form a portion of the channel 216.

The one or more sets of radially disposed holes may further define a hole configuration of the core 112 of the suppressor 100. For example, the hole configuration of the core 112 may include various configurations of hole(s) 410, hole(s) 506, hole(s) 902, hole(s) 904, and/or any additional or alternative hole(s) associated with one or more component(s) of the core 112. The hole configuration may include one or more hole types defined by one or more diameters or profiles. For example, the hole configuration may include one or more holes having a circular, diamond, oval, and/or teardrop profile or any other suitable hole profile.

In various embodiments(s), the first baffle(s) 210, the second baffle(s) 212, and/or one or more other baffle(s) may be rigidly coupled to one another, thereby forming, in whole or in part, a baffle structure (such as baffle structure 1302 illustrated in FIGS. 13A-13B and further described below), which may be disposed within and rigidly coupled to or otherwise engaged with the main housing 108. In some embodiments, the first baffle(s) 210, the second baffle(s) 212, and/or the other baffle(s) may each have the same baffle configuration. In other embodiments, the first baffle(s) 210, the second baffle(s) 212, and/or the other baffle(s) may each have a different baffle configuration. In certain embodiments, the baffle structure may be modular in configuration. For example, the first baffle(s) 210, the second baffle(s) 212, and/or the other baffle(s) may be configured to be oriented interchangeably with respect to one another, which may provide for improved customization of the suppressor 100. Regardless of orientation or baffle configuration, at least one channel may be defined by the baffle structure and have dimensions such that the baffle structure may be disposed around the valve core 214. For example, baffle structure 1302 may define channel 1304 (illustrated in FIG. 13A), which may be concentric or substantially concentric with the channel 216 and may have a diameter greater than a diameter of the valve core 214 such that the valve core 214 may be disposed within the channel 1304. In this manner, the aforementioned main can 104 and the core 112 may be axially biased, with respect to one another, without resulting in any engagement between the valve core 214 and the baffle structure 1302 that might hinder the axial biasing.

The boost housing 106 may be disposed around at least a portion of the boost core 204, the boost sleeve 206, and/or the spring 202. The main housing 108 may be disposed around and/or engaged with the first baffle(s) 210, the second baffle(s) 212, and/or any other baffle(s) included in the baffle structure. As illustrated by the present embodiment, the suppressor 100 may include one boost housing 106 and one main housing 108. It will be understood by those having skill in the art, however, that inclusion of one or more additional boost housing(s) 106 and/or main housing(s) 108 is envisioned by the present disclosure. For example, in various embodiments, the core 112 may include any number of valve core(s) 214 rigidly coupled to one another, while the baffle structure may include any number of first baffle(s) 210, second baffle(s) 212, and/or other baffle(s). In this manner, an overall length of the core 112 and/or the baffle structure may vary. Accordingly, the main can 104 may include one or more additional boost housing(s) 106 and/or main housing(s) 108 rigidly coupled to one another and having an overall length that is adjustable based on the overall length of the core 112 and/or the baffle structure. It should further be understood that the baffle structure may be a component of the main can 104 or may be a separate component. For example, in some embodiments, the main can 104 may include one or more boost housing(s) 106 and/or main housing(s) 108 but not the baffle structure, whereas, in other embodiments (such as the present embodiment), the main can 104 may include the baffle structure. Thus, the functionality and configuration of the suppressor 100 may be further customized as desired.

One or more O-ring(s) or gasket(s) 208 may disposed within and/or around various components of the suppressor 100 to provide airtight and/or watertight seal(s) against an external environment or with respect to different internal volumes or chambers of the suppressor 100. For example, O-ring(s) or gasket(s) 208 may be disposed around the mounting cap 102 and/or the boost core 204, at the interface of the two, to prevent leakage of gas to the external environment except via intended egress at, for example, the discharge cap 110. Alternatively, or in addition, O-ring(s) or gasket(s) 208 may be disposed between the first baffle(s) 210 and/or the second baffle(s) 212 to prevent unintended leakage of gas from within the baffle structure when the firearm is discharged. Of course, it will be understood by those having skill in the art that numerous dispositions of O-ring(s) or gasket(s) 208 to form airtight or watertight seals within and/or about the suppressor 100 are further envisioned by the present disclosure.

At one end of the suppressor 100, the discharge cap 110 may be rigidly coupled to the main housing 108. At an opposite end of the suppressor 100, the boost core 204 may be configured to be coupled to a firearm, including but not limited to one of the firearms described herein. When the firearm is coupled to the boost core 204 and subsequently discharged, a volume of gas produced by the discharge may travel between the boost core 204 and the discharge cap 110 via the channel 216 and/or the other channel(s) described herein.

It will be understood by those having skill in the art that numerous means of mating, coupling, interfacing, engaging, and/or rigidly coupling components to one another are envisioned by the present disclosure. For example, in various embodiments, rigidly coupling one component to another may include screwably connecting, welding, fastening, securing, gluing, or otherwise fixably mating the components to one another. In certain embodiments, rigidly coupling one component to another may be directionally dependent, such that the components may be moveable with respect to one another in one direction but restricted from traveling with respect to one another in a different direction. In some embodiments, rigidly coupled components may be separable from one another, for example, during assembly or disassembly and/or during certain other operations. It will further be understood that the particular manners of mating, coupling, and/or rigidly coupling or otherwise associating components with one another are described herein for illustrative purposes only and that numerous other configurations and/or manners of assembly are envisioned by the present disclosure.

Figure 3A:
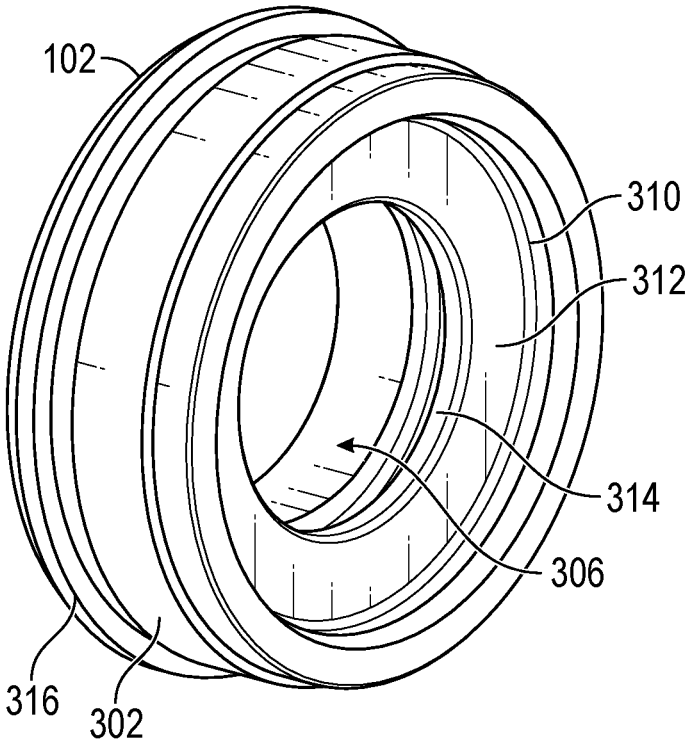
FIGS. 3A-3B are perspective and front views of a mounting cap in accordance with one or more exemplary embodiments of the disclosure.
Figure 3B:
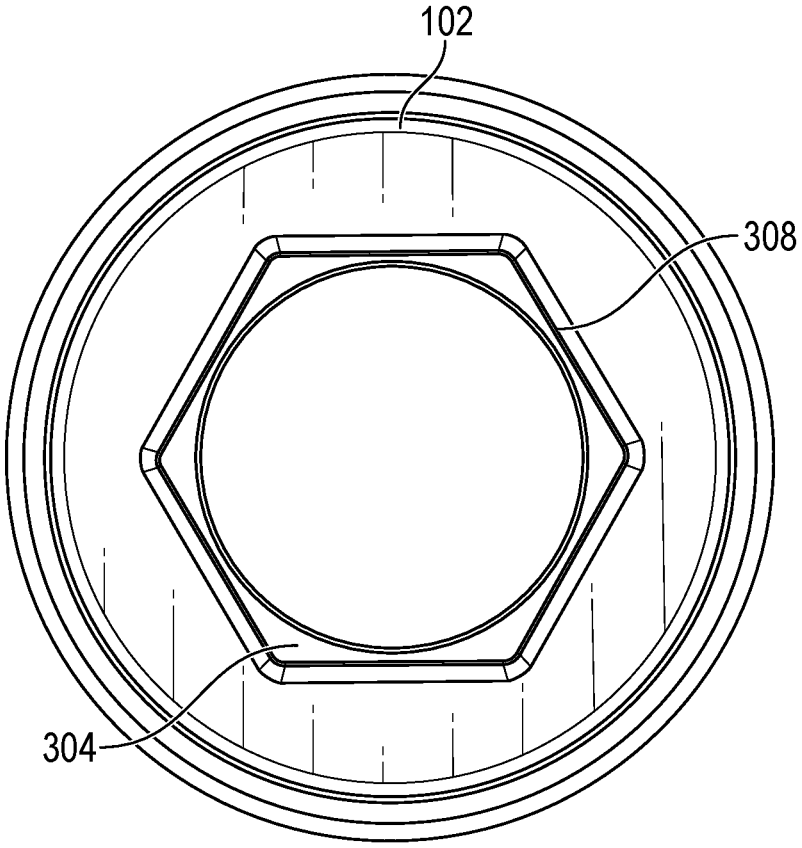

Referring now to FIGS. 3A-3B, and in brief overview, the mounting cap 102 may define channel 306 and may include ring 302, surface 304, protrusion 308, protrusion 310, shelf 312, coupling mechanism 314, and/or lip 316. In some embodiments, the mounting cap 102 may be configured to couple to the boost housing 106 flush against the lip 316 of the mounting cap 102. The ring 302 may engage with a corresponding ring of the boost housing 106, such as ring 602 (illustrated in FIG. 6A and further described below) to secure the mounting cap 102 to the boost housing 106. The shelf 312 may be oriented facing toward the remaining components of the suppressor 100. The shelf 312 may abut the spring 202 and/or the boost sleeve 206, which may be located within or about the protrusion 310 when the suppressor 100 is assembled. The coupling mechanism 314 may include, for example, screw threads, which may be used to secure the boost core 204 through the channel 306 of the mounting cap 102, and/or one or more O-ring(s) or gasket(s), such as O-ring(s) or gasket(s) 208 (illustrated in FIG. 2 and further described above). The surface 308 may face an opposing end of the channel 306 (i.e., the end furthest from the remaining components of the suppressor 100 and closest to a firearm when coupled to the suppressor 100) and intersect with protrusion 308. The protrusion 308 may function to provide grip and/or surface to tighten the mounting cap 102 onto the boost core 204 and/or the boost housing 106 and/or to assist in securing the boost core 204 onto the firearm.

Figure 4A:
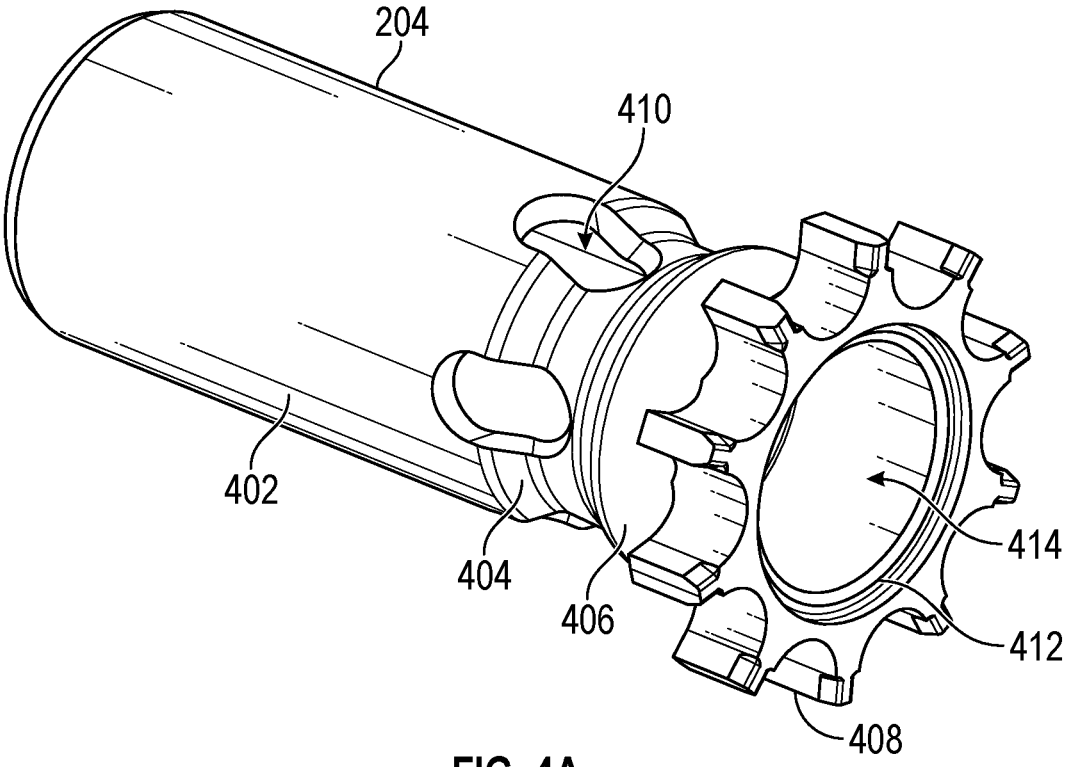
FIGS. 4A-4B are perspective and front views of a boost core in accordance with one or more exemplary embodiments of the disclosure.
Figure 4B:
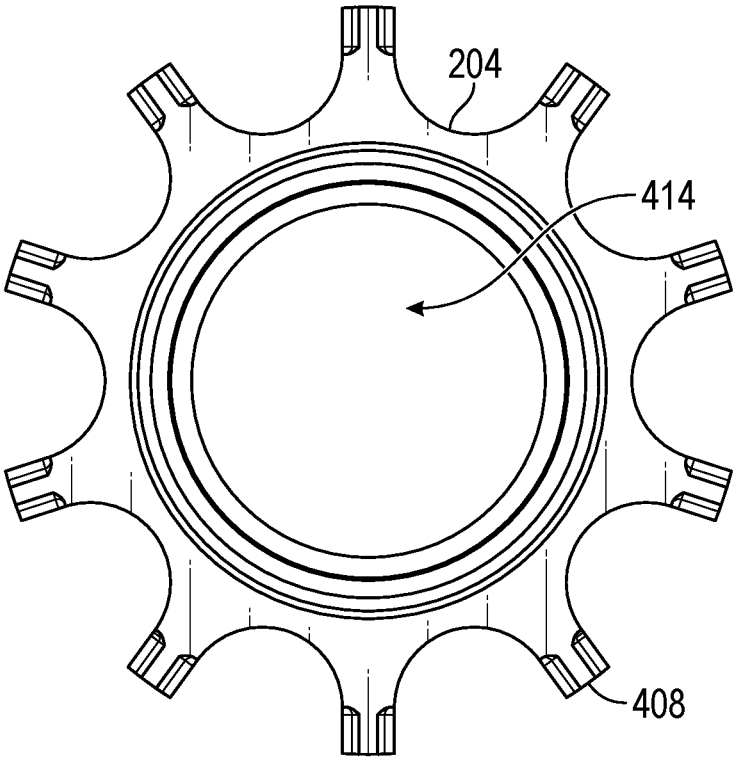

Referring now to FIGS. 4A-4B, and in brief overview, the boost core 204 may define channel 414 intersecting one or more hole(s) 410 and may include one or more section(s) (e.g., first cylindrical section 402, tapered section 404, and/or second cylindrical section 406), one or more radial extrusion(s) 408, and/or coupling mechanism 412. In some embodiments, the first cylindrical section 402, the tapered section 404, and/or the second cylindrical section 406 may define the channel 414, which may be disposed around the channel 216 when the suppressor 100 is assembled. The hole(s) 410 may be radially spaced about and/or intersect with any of the first cylindrical section 402, the tapered section 404, the second cylindrical section 406, or any combination thereof. The hole(s) 410 may be of any configuration, shape, or size and may be used to control a flow of a volume of gas produced by a discharge of a firearm, for example, as part of a valve action of the suppressor 100. In the present embodiment, for example, the hole(s) 410 extend across the first cylindrical section 402 and the tapered section 404 of the boost core 204. The coupling mechanism 412 may include, for example, threads or indents configured to facilitate rigid coupling of the boost core 204 to the valve core 214. An end of the boost core 204 opposite the coupling mechanism 412 may include a similar coupling mechanism (e.g., one including threads or indents) for securing the boost core 204 to the barrel of the firearm. In various embodiments, the radial extrusion(s) 408 may be configured to engage with the boost sleeve 206 so as to limit rotation of the main can 104 about the valve core 214.

Figure 5A:
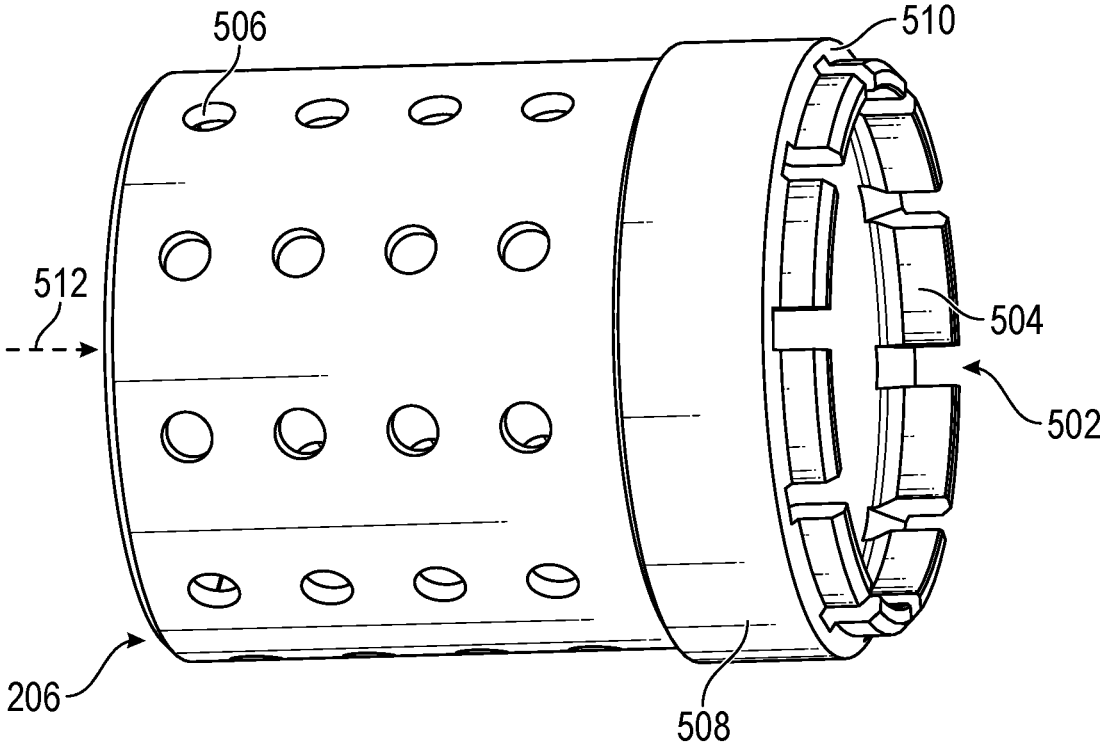
FIGS. 5A-5B are perspective and front views of a boost sleeve in accordance with one or more exemplary embodiments of the disclosure.
Figure 5B:
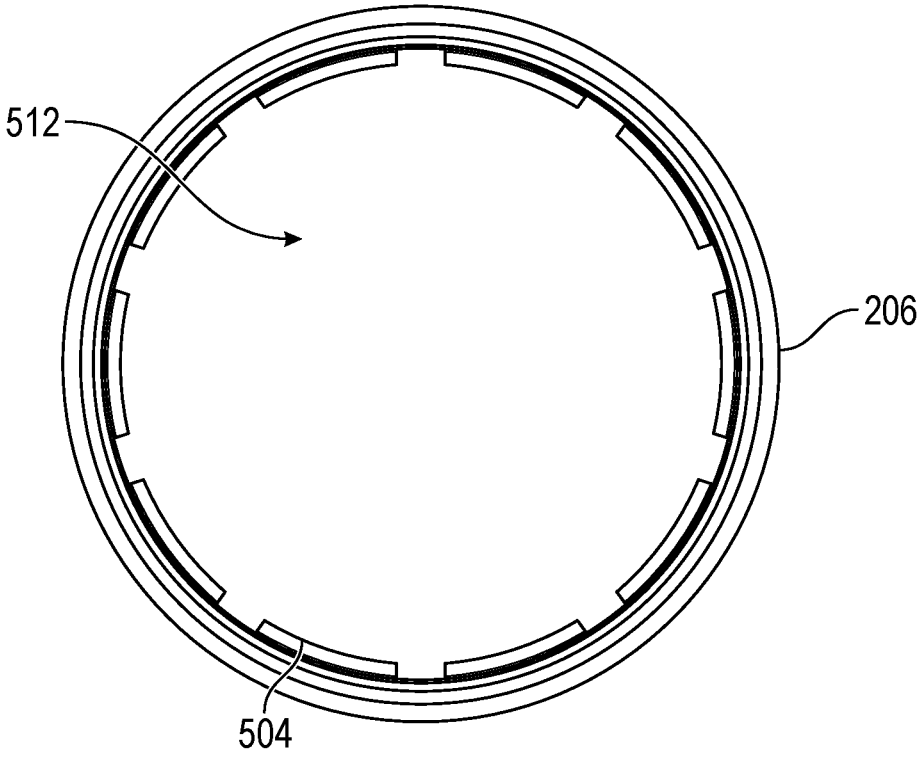

Referring now to FIGS. 5A-5B, and in brief overview, the boost sleeve 206 may define channel 512 intersecting one or more hole(s) 506 and may include one or more protrusion(s) 504, ridge 508, and/or lip 510. The ridge 508 may be configured to abut a corresponding ring of the boost housing, such as tapered ring 610 of the boost housing 106 (illustrated in FIG. 6A and further described below), to help secure the boost housing 106 with respect to the boost sleeve 206. The lip 510 may be located around an edge of the ridge 508 and may be configured to abut a corresponding lip of the boost housing 106, such as lip 614 (illustrated in FIG. 6A and further described below). The protrusion(s) 504 may be radially spaced between space(s) 502 and extend axially with respect to the channel 512. The space(s) 502 may be configured to receive the radial extrusion(s) 408 of the boost core 204. The protrusion(s) 504 may be configured to abut a shelf of the boost housing 106, such as shelf 606 (illustrated in FIGS. 6A-6B and further described below) and/or to secure the boost sleeve 206 within the mounting cap 102 and/or the boost housing 106. The hole(s) 506 may be radially aligned along the body of the boost sleeve 206. The hole(s) 506 may be of any configuration, shape, or size and may be used to control a flow of a volume of gas produced by a discharge of a firearm, for example, as part of a valve action of the suppressor 100.

Figure 6A:
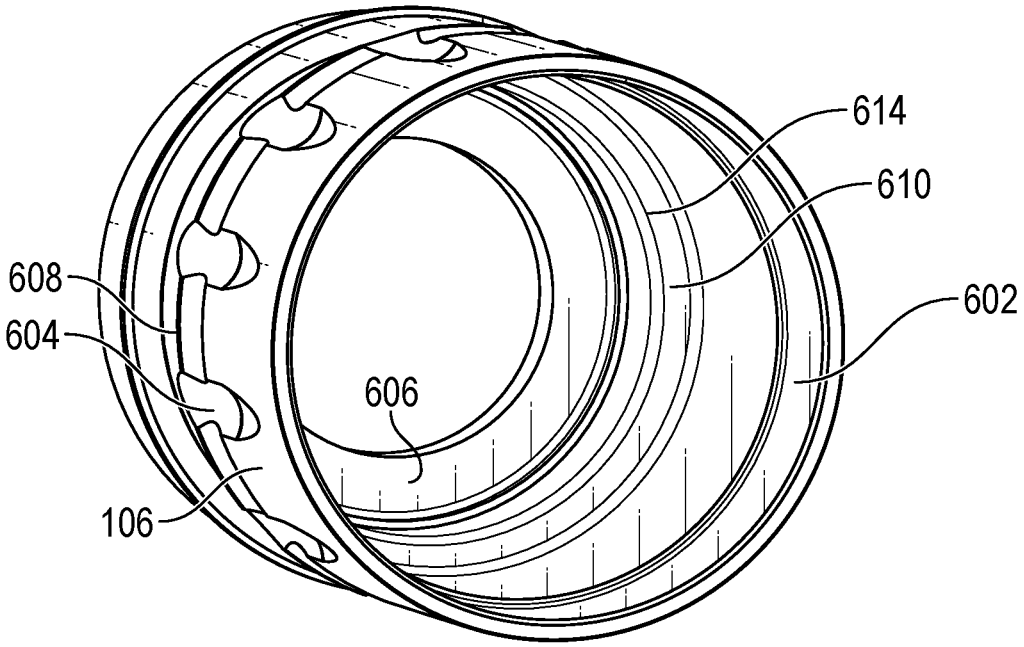
FIGS. 6A-6B are perspective views of a boost housing in accordance with one or more exemplary embodiments of the disclosure.
Figure 6B:
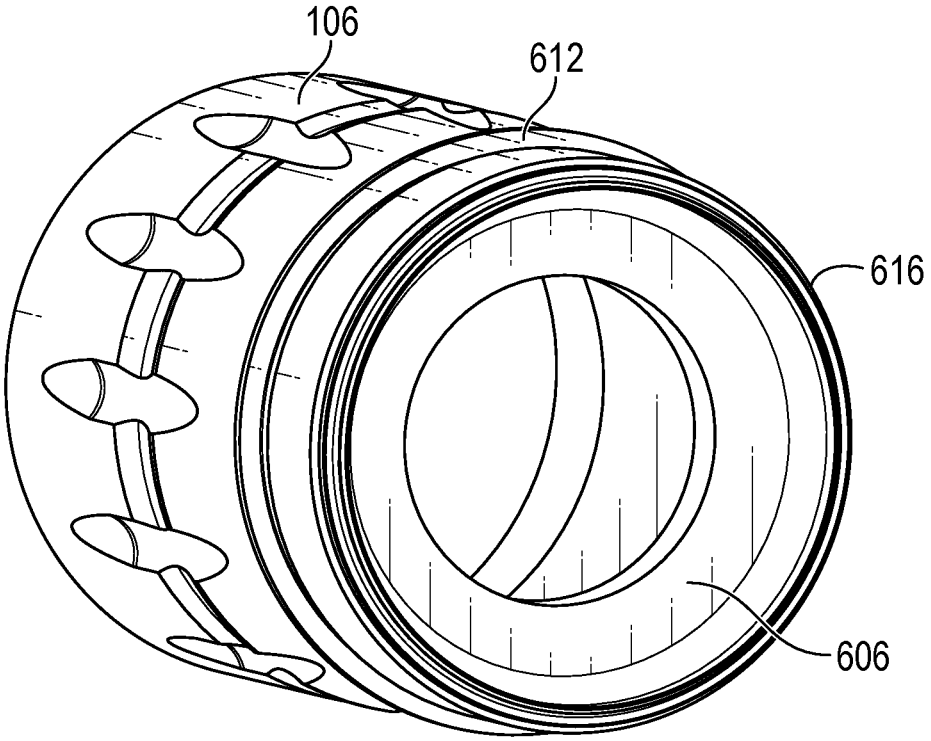

Referring now to FIGS. 6A-6B, and in brief overview, the boost housing 106 may include ring 602, one or more groove(s) 604, shelf 606, channel 608, tapered ring 610, shelf 612, lip 614, and/or ring 616. The ring 602 may be configured to fit over the ring 302 of the mounting cap 102 to secure the boost housing 106 to the mounting cap 102. The groove(s) 604 may be radially spaced around an external surface of the boost housing 106. The groove(s) 604 may be connected by the channel 608, which may extend circumferentially around the external surface of the boost housing 106. The shelf 606 may be located within the boost housing 106 and abut the boost core 204, the spring 202, and/or the boost sleeve 206 opposite the shelf 312 of the mounting cap 102. The shelf 606 may, additionally or alternatively, abut a baffle, such as one of the first baffle(s) 210, one of the second baffle(s) 212, or another baffle, on a side of the shelf 606 facing the discharge cap 110 and thereby secure the baffle against the shelf 606 and/or against the ring 616. The tapered ring 610 may provide for further stabilization of securement of the boost sleeve 206. The lip 614 may configured to abut the lip 510 of the boost sleeve 206 to secure the boost housing 106 to the boost sleeve 206. The ring 616 may be configured to be located within a corresponding ring of the main housing 108, such as ring 1406 of the main housing 108 (illustrated in FIG. 14B and further described below) to secure the main housing 108 to the boost housing 106. The ring 1406 may abut the shelf 612 to further secure the main housing 108 to the boost housing 106.

Figure 7:
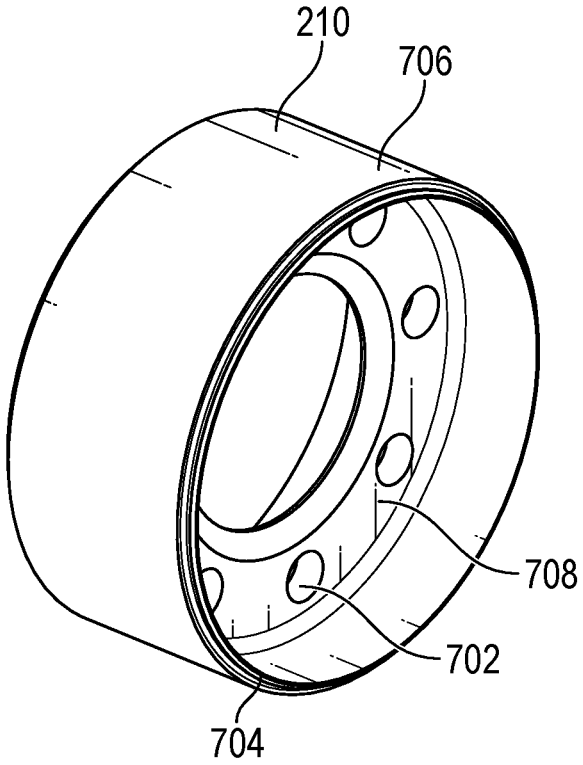
FIG. 7 is a perspective view of a baffle in accordance with one or more exemplary embodiments of the disclosure.

Referring now to FIG. 7, and in brief overview, the first baffle(s) 210 may include one or more bore(s) 702, ledge 704, external surface 706, and/or baffle wall 708. The ledge 704 may be located around an edge of the exterior surface 706 and configured to engage with a corresponding ledge of another baffle, such as ledge 704 of one of the first baffle(s) 210 or ledge 806 of one of the second baffle(s) 212 (illustrated in FIG. 8 and further described below). The baffle wall 708 may extend inward from the exterior surface 706 and may include the bore(s) 702 in, for example, a radially disposed pattern around the baffle wall 708. The bore(s) 702 may be of any configuration, shape, or size and may be used to control a flow of a volume of gas produced by a discharge of a firearm, for example, as part of a valve action of the suppressor 100. For example, the bore(s) 702 may control the flow of the volume of gas between one baffle and the next.

Figure 8:
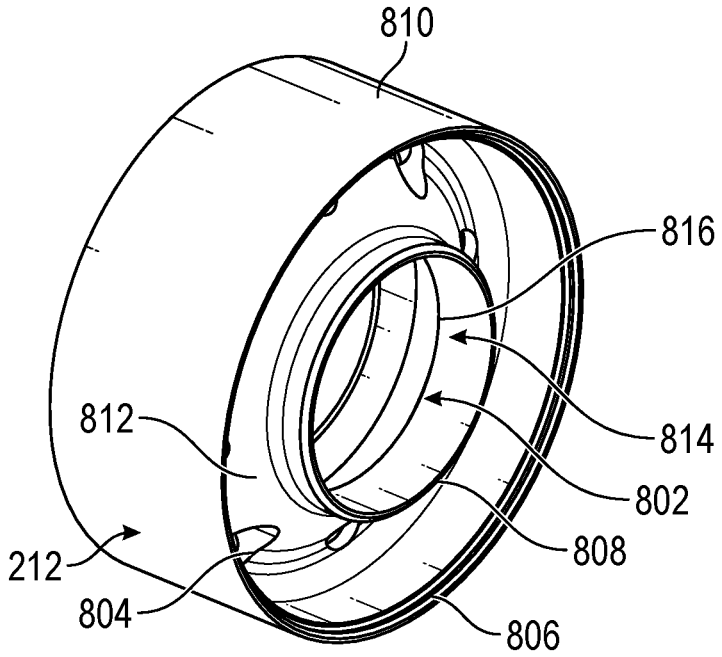
FIG. 8 is a perspective view of a baffle in accordance with one or more exemplary embodiments of the disclosure.

Referring now to FIG. 8, and in brief overview, the second baffle(s) 212 may define channel 802 and may include one or more bore(s) 804, ledge 806, lip 808, exterior surface 810, baffle wall 812, inner channel 814, and one or more ridge(s) 816. The ledge 806 may be located around an edge of the exterior surface 810 and configured to engage with a corresponding ledge of another baffle, such as ledge 704 of one of the first baffle(s) 210 or ledge 806 of one of the second baffle(s) 212. The baffle wall 812 may extend inward from the exterior surface 810 and may include the bore(s) 804 in, for example, a radially disposed pattern around the baffle wall 812. The bore(s) 804 may be of any configuration, shape, or size and may be used to control a flow of a volume of gas produced by a discharge of a firearm, for example, as part of a valve action of the suppressor 100. For example, the bore(s) 804 may control the flow of the volume of gas between one baffle and the next. The lip 808 may define channel 802, which may outline the channel 216 when the suppressor 100 is assembled. The inner channel 814 may extend around an inner circumference of the second baffle(s) 212 beside one or more ridge(s) 816. In some embodiments, the inner channel 814 may intersect with the channel 802 and the bore(s) 804 such that the volume of gas may travel between the channel 802, the inner channel 814, and/or the bore(s) 804. In other embodiments, the ridge(s) 816 may converge such that the inner channel 814 does not extend to the exterior surface 810.

Figure 9A:
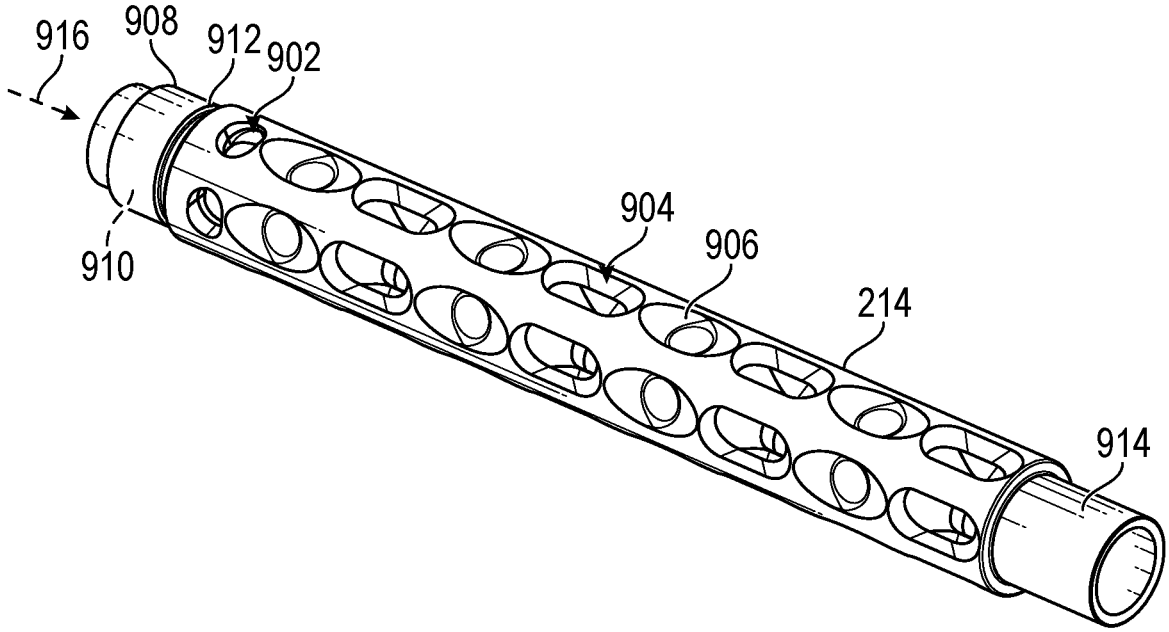
FIGS. 9A-9B are perspective and side views of a valve core in accordance with one or more exemplary embodiments of the disclosure.
Figure 9B:
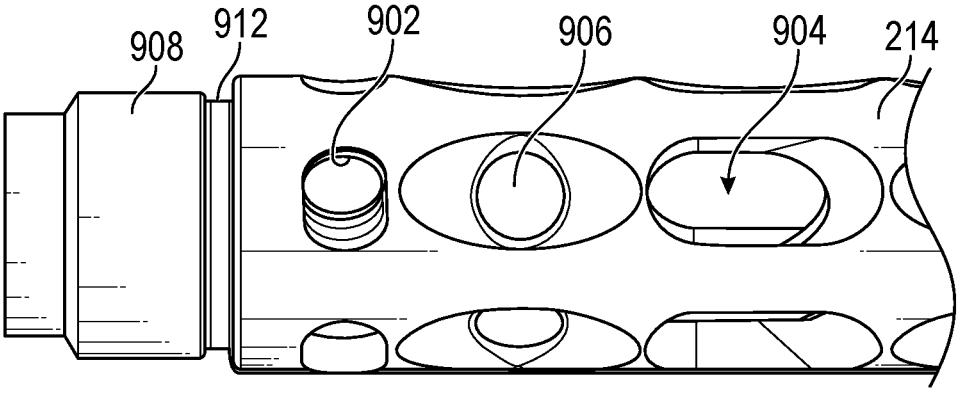

Referring now to FIGS. 9A-9B, and in brief overview, the valve core 214 may define channel 916 intersecting one or more first hole(s) 902, one or more second hole(s) 904, and/or one or more other holes and may include one or more indent(s) 906, outer ring 908, interior ring 910, recessed portion 912, and end 914. The first hole(s) 902, the second hole(s) 904 and/or any other holes may be radially aligned along the body of the valve core 214. The first hole(s) 902, the second hole(s) 904, and/or any other holes may be of any configuration, shape, or size and may be used to control a flow of a volume of gas produced by a discharge of a firearm, for example, as part of a valve action of the suppressor 100. The indent(s) 906 may be radially spaced along the body of the valve core 214 and may further or alternatively control the flow of the volume of gas. The indent(s) 906 may be of any space, size, depth, length, spacing, or other configuration as desired to control the flow of the volume of gas. The valve core 214 may be configured to couple with the boost core 204 about the outer ring 908, the recessed portion 912 and/or the inner ring 910. In some embodiments, for example, the valve core 214 may be configured to be screwably connected to the boost core 204, such as in association with coupling mechanism 412 (illustrated in FIG. 4A and further described above). The end 914 of the valve core 214 may be configured to facilitate coupling, engagement, or interfacing of the valve core 214 and the discharge cap 120, such as by lacking any indents or holes to ensure smooth and proper coupling or engagement. For example, the discharge cap 120 may be configured to slide back and forth along the end 914 of the valve core 214. In some embodiments, one or more contour surface(s) and/or recess(es) may be located around and/or defined by the first hole(s) 902, the second hole(s) 904, and/or the indent(s) 906, which may further facilitate the flow of the volume of gas.

Figure 10A:
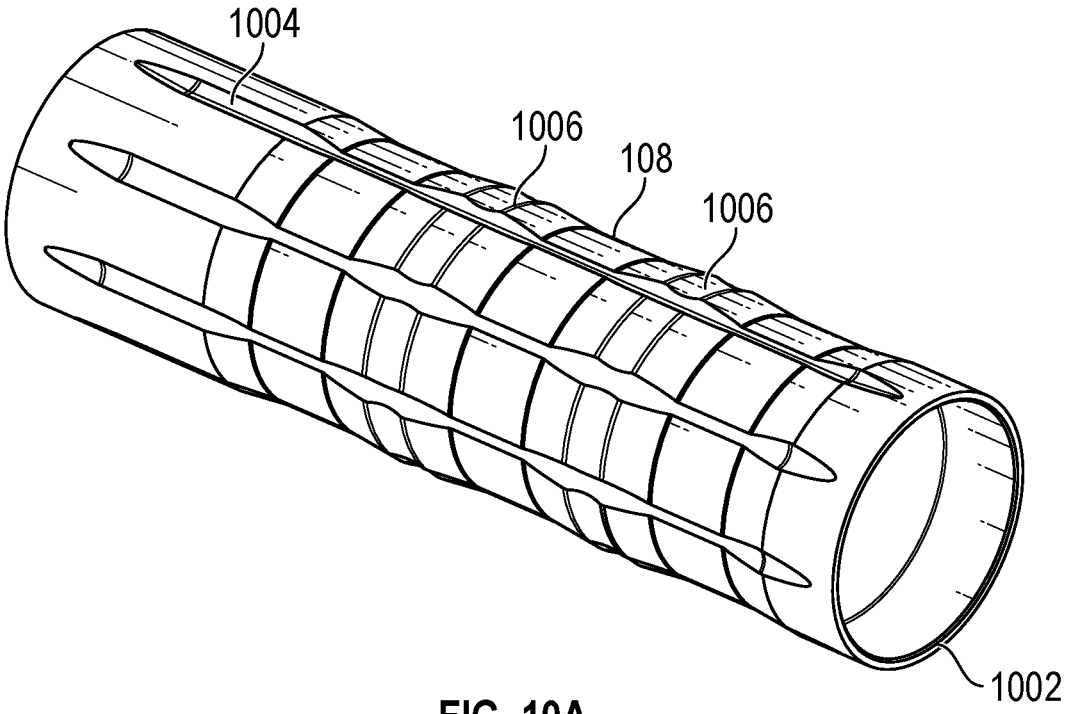
FIGS. 10A-10B are perspective views of a main housing in accordance with one or more exemplary embodiments of the disclosure.
Figure 10B:
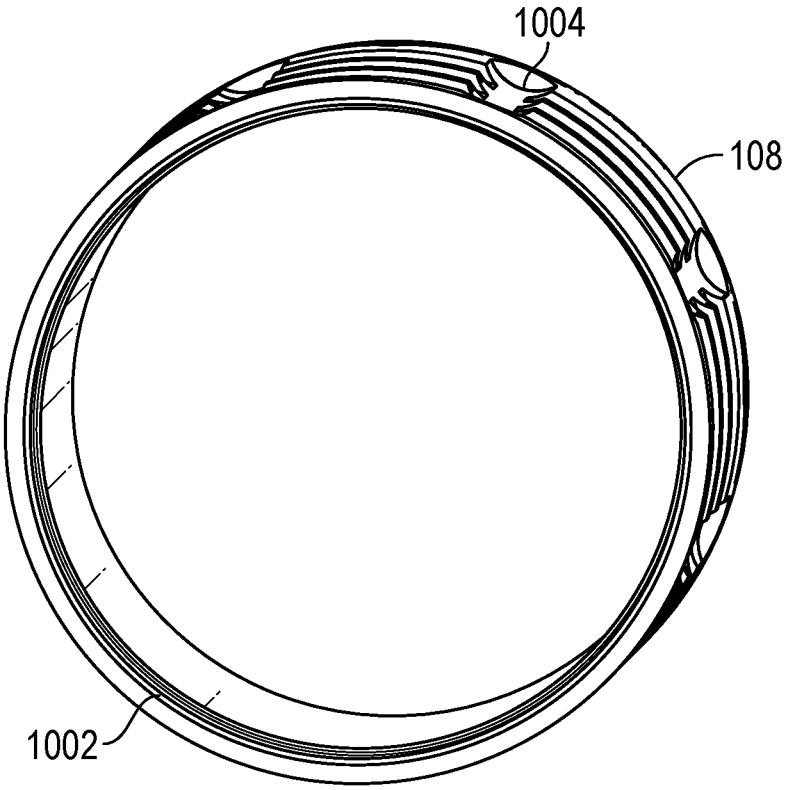

Referring now to FIGS. 10A-10B, and in brief overview, the main housing 108 may include inner ridge 1002, one or more groove(s) 1004, and one or more outer ridge(s) 1006. The main housing may be configured with any suitable exterior profile. For example, the groove(s) 1004 may be radially disposed around an exterior surface of the main housing 108. The outer ridge(s) may circumferentially extend around the exterior surface of the main housing 108 and may, thereby, intersect with the groove(s) 1004. In some embodiments, such as the present embodiment, the main housing 108 may have a tapered profile decreasing slightly in diameter from one end closest to the mounting cap 102 to another end closest to the discharge cap 110 (when the suppressor 100 is assembled). The inner ridge 1002 may engage with a corresponding ring of the discharge cap 110, such as ring 1102 (illustrated in FIGS. 11A-11B and further described below), to couple or engage the main housing 108 and the discharge cap 110 with respect to one another.

Figure 11A:
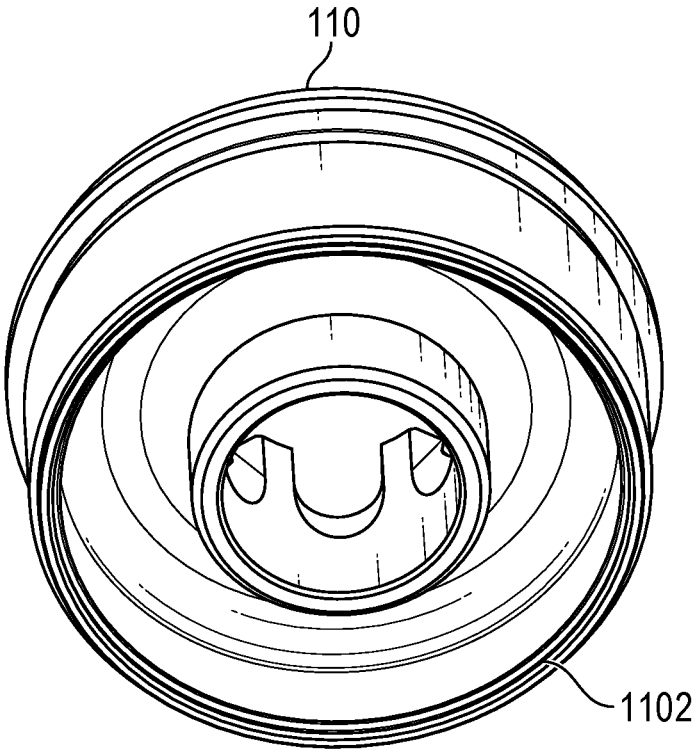
FIGS. 11A-11B are perspective views of a discharge cap in accordance with one or more exemplary embodiments of the disclosure.
Figure 11B:
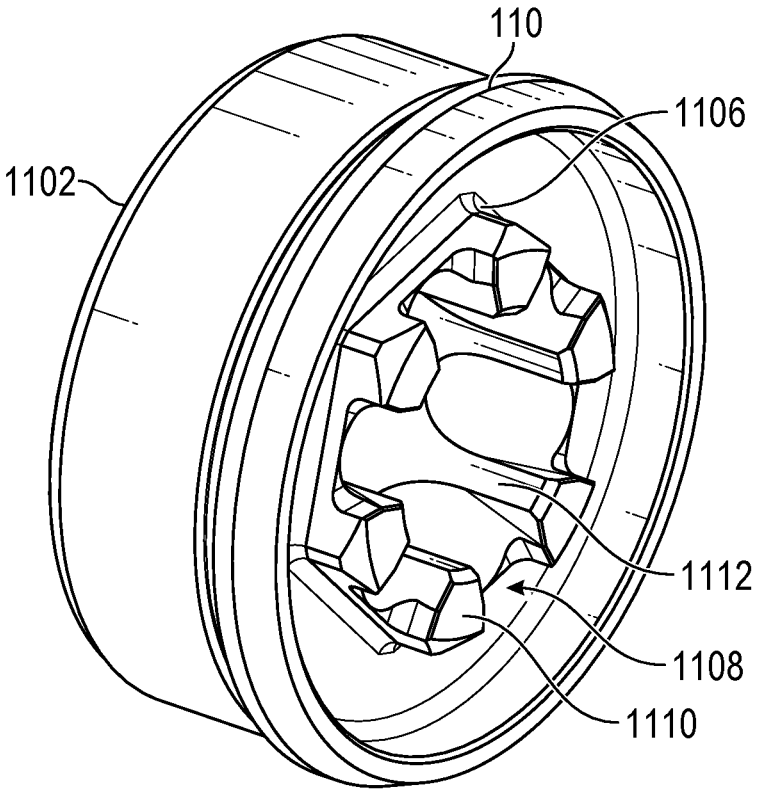

Referring now to FIGS. 11A-11B, and in brief overview the discharge cap 110 may include ring 1102, structure 1106, one or more protrusion(s) 1110, and/or radial wall 1112. The ring 1102 may be configured to rigidly couple or otherwise engage with the inner ridge 1002 of the main housing 108, thereby securing the discharge cap 110 to the main housing 108. The structure 1106 may be centrally located within the discharge cap and may include the protrusion(s) 1110 separated by one or more space(s) 1108. The protrusion(s) 1110 may be radially dispersed and may extend axially outward from the discharge cap 102. The protrusion(s) 1110 may form the radial wall 1112 within the discharge cap 110. The protrusion(s) 1110 and/or space(s) 1108 may vary in size, shape, number, and/or placement. The structure 1106 may thereby be configured to define a radial aperture profile controlling an egress of a volume of gas produced by a discharge of a firearm that travels through the channel 216 when the suppressor 100 is assembled.

Figure 12:
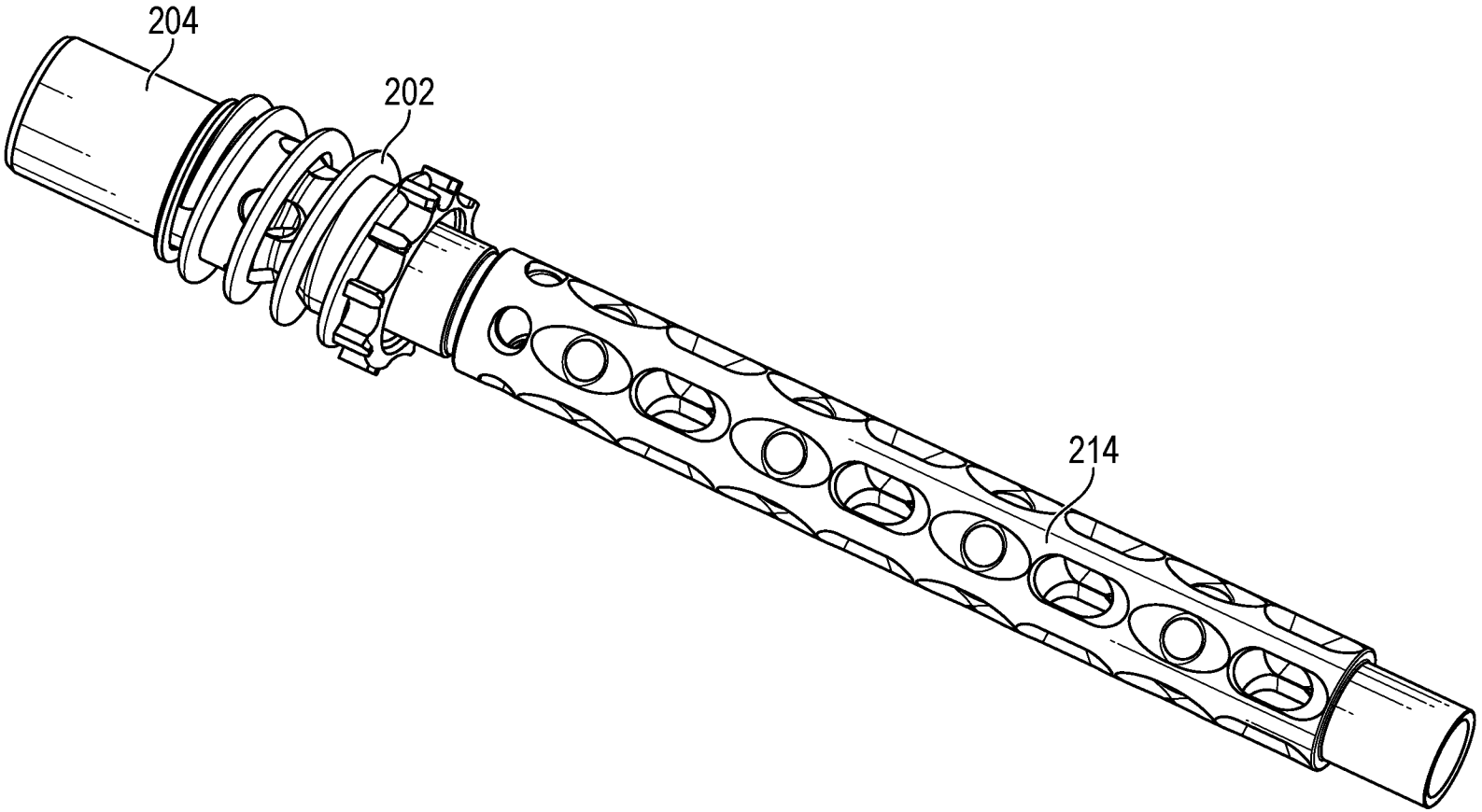
FIG. 12 is a perspective view of a boost core, a valve core, and a spring in accordance with one or more exemplary embodiments of the disclosure.

Referring now to FIG. 12, and in brief overview, the boost core 204 and the valve core 214 may be rigidly coupled together. The spring 202 may be disposed around the boost core 204. As previously described, one or more hole(s) of the boost core 204 and/or the valve core 214, may, alone or in combination with one or more hole(s) of the boost sleeve 206 (not shown), constitute at least a portion of the hole configuration of the core 112 of the suppressor 100. This hole configuration may serve to direct a flow of a volume of gas produced by a discharge of a firearm when the suppressor 100 is assembled. The spring 202 may be configured to axially bias one or more components of the suppressor 100 with respect to at least the boost core 204 and the valve core 214 responsive to the discharge of the firearm. For example, the spring 202 may contact and bias a mounting cap (e.g., mounting cap 102 illustrated in FIGS. 1-2), which may bias a main can (e.g., main can 104 illustrated in FIGS. 1-2) toward a breach end of a firearm when the suppressor 100 is coupled to the firearm. Various configurations and/or components of the boost core 204 and/or the valve core 214 may limit the extent of any biasing caused by the spring 202. For example, such biasing may be limited by the configuration(s) of the radial extrusion(s) 408 of the boost core 204 (illustrated in FIGS. 4A-4B) with respect to the boost housing 106 (illustrated in FIGS. 1-2) and/or by the end 914 of the valve core 214 (illustrated in FIG. 9A) with respect to the discharge cap 110 (illustrated in FIGS. 1-2). As such, the boost core 204, the valve core 214, and/or the spring 202 may be critical components in accomplishing the valve action that may be facilitated by the suppressor 100 when assembled and used with a firearm.

Figure 13A:
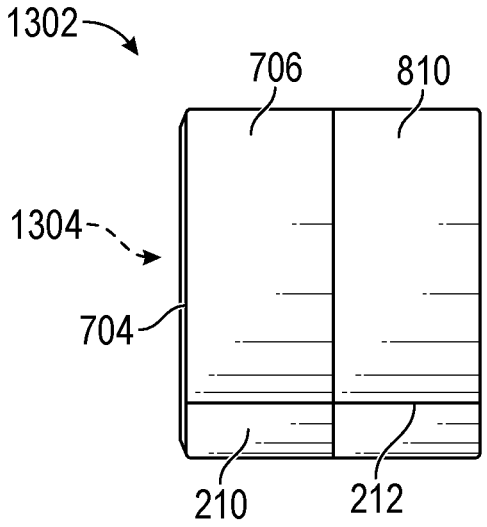
FIGS. 13A-13B are side and cross-sectional views of a baffle structure in accordance with one or more exemplary embodiments of the disclosure.
Figure 13B:
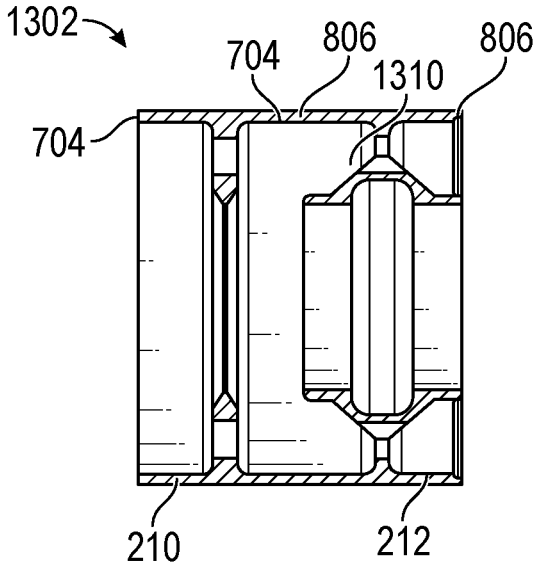

Referring now to FIGS. 13A-13B, and in brief overview, baffle structure 1302 may define channel 1304 and one or more chamber(s) 1310 and may include at least the first baffle(s) 210 and/or the second baffle(s) 212, in addition to or instead of one or more other baffle(s). In various embodiments, the first baffle(s) 210 and/or the second baffle(s) 212 may be rigidly coupled to one another. For example, each ledge 704 of the first baffle(s) 210 may correspond to another ledge 704 and/or to each ledge 806 of the second baffle(s) 212, while each ledge 806 may further or alternatively correspond to another ledge 806, such that the first baffle(s) 210 and/or the second baffle(s) 212 may be concentrically mated to one another. In some embodiments, for example, this mating may include screwably connecting the first baffle(s) 210 and/or the second baffle(s) 212 to one another, although other means of mating and/or rigidly coupling are certainly envisioned herein. In some embodiments, one or more O-ring(s) or gasket(s) 208 may be installed within the baffle structure to prevent unintended leakage of gas.

The chamber(s) 1310 may be entirely included within the first baffle(s) 210 and/or the second baffle(s) 212. In some embodiments, for example, the first baffle(s) 210 may include open portion of the chamber(s) 1310, while the second baffle(s) 212 may include another open portion of the chamber(s) 1310, thereby requiring two of the first baffle(s) 210 and/or the second baffle(s) 212 to form the chamber(s) 1310. In some embodiments, the channel 1304 defined by the baffle structure 1302 may intersect the chamber(s) 1310. In other embodiments, access to the chamber(s) 1310 may be via a different channel, hole, and/or bore, either included within the baffle structure 1302 or otherwise. It will be understood by those having skill in the art that numerous other chamber configurations requiring one or more baffles are envisioned by the present disclosure.

The configuration of the first baffle(s) 210 may be the same or different from that of the second baffle(s) 212. In various embodiments the outer surface 706 of each of the first baffle(s) 210 may be the same or substantially similar to that of the outer surface 810 of each of the second baffle(s) 212. In some embodiments, the orientation of the first baffle(s) 210 with respect to one another and/or with respect to the second baffle(s) 212 may be reconfigured. In other words, the baffle structure 1302 may be modular in assembly such that the definition of the channel 1304 and or the chamber(s) 1310 may be modified or adjusted without the need for a different suppressor from the suppressor 100.

Referring now to FIGS. 14A-14F, and in brief overview, the suppressor 100 may include the mounting cap 102, the boost core 204, the valve core 214, the boost housing 106, the first baffle(s) 210, the second baffle(s) 212, main housing 108, and the discharge cap 110. The suppressor may be configured in accordance with any of the embodiments described and/or illustrated herein, or in accordance with any other embodiment envisioned by the present disclosure.

Various components, including but not limited to the ring 302 of the mounting cap 102, the ring 602 and/or the ring 616 of the boost housing 106, the outer ring 908 and/or the interior ring 910 of the valve core 214, the inner ridge 1002 and/or the ring 1406 of the main housing 108, and/or the ring 1102 of the discharge cap 110, may be engaged or coupled to one another and/or to other components of the suppressor 100 as illustrated and/or described throughout the present disclosure or otherwise to secure the one or more components of the suppressor 100 together. For example, the aforementioned components may include screw threads and be screwably connected. The boost core 204 and the valve core 214 may include corresponding protrusions extending outward in an axial direction along the channel 216. The outer ring 908 and/or the interior ring 910 may be configured to hold these protrusions together. The ring 1406 of the main housing 108 may fit over the ring 616 of the boost housing 106 to hold the main housing 108 and the boost housing 106 together.

In various embodiments, the channel 216 may extend along a longitudinal axis of the suppressor 100, for example, between the mounting cap 102 and the discharge cap 110 through the boost core 204 and the valve core 214. The channel 216 may be configured such that a round discharged from a firearm, along with a volume of gas produced by the discharge, may travel through the channel 216 when the suppressor 100 is coupled to the firearm.

Figure 14A:
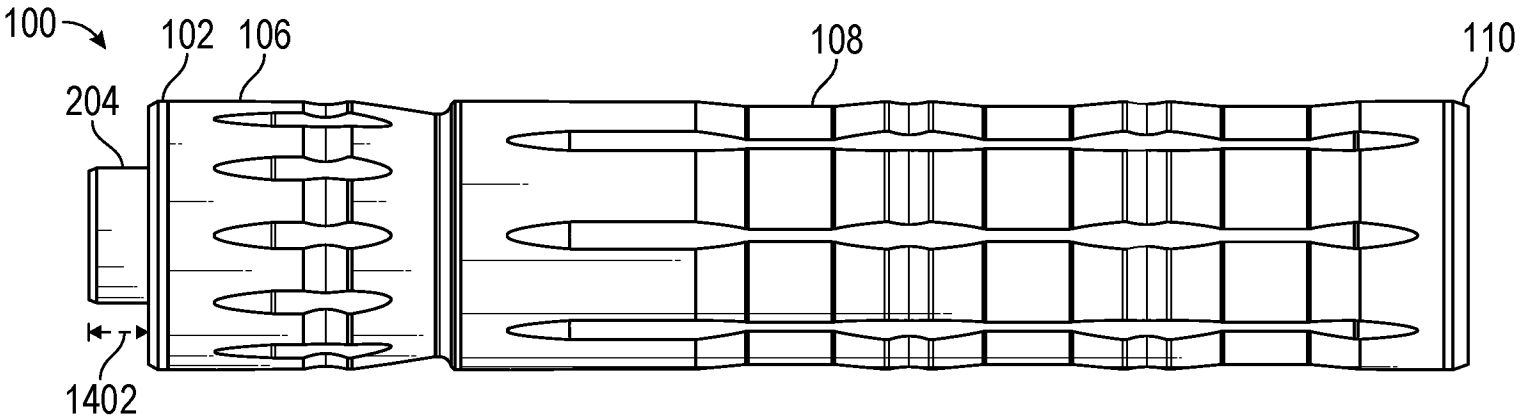
FIGS. 14A-14F are side and cross-sectional views of a suppressor, oriented in various positions, in accordance with one or more exemplary embodiments of the disclosure.
Figure 14B:
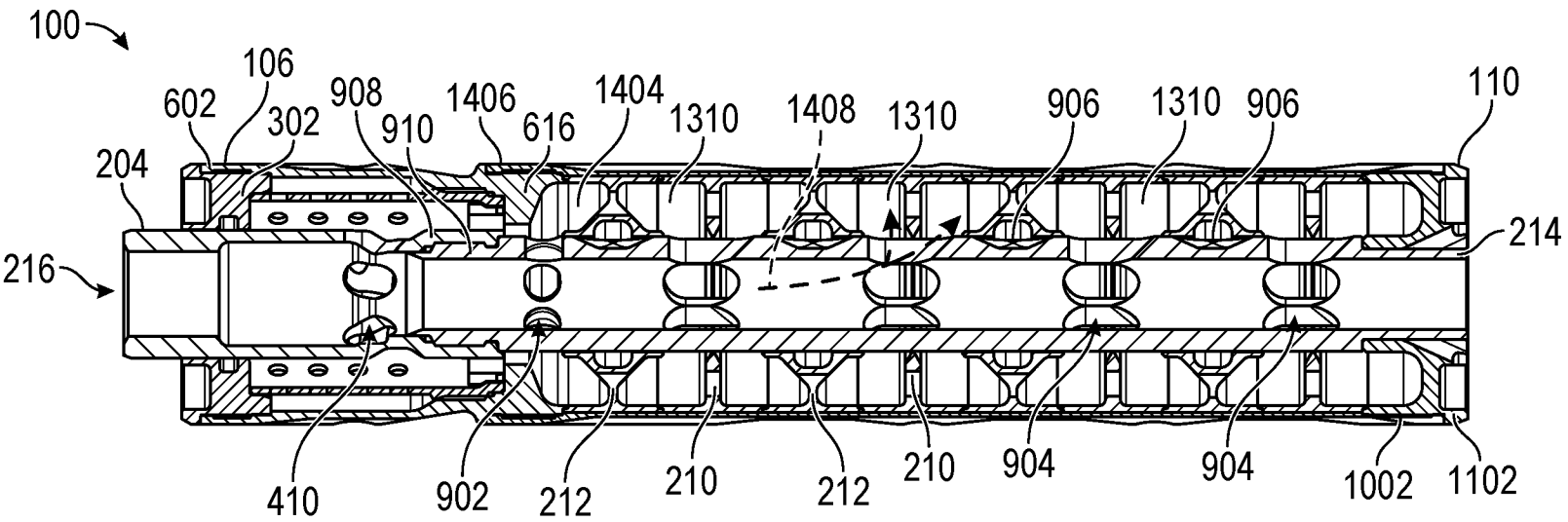
Figure 14C:
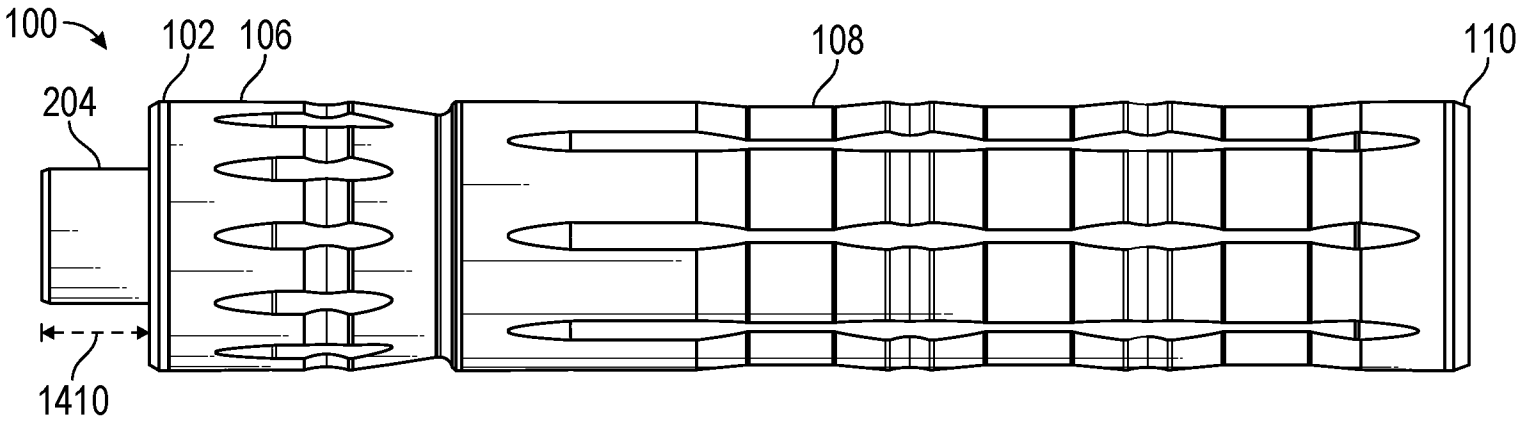
Figure 14D:
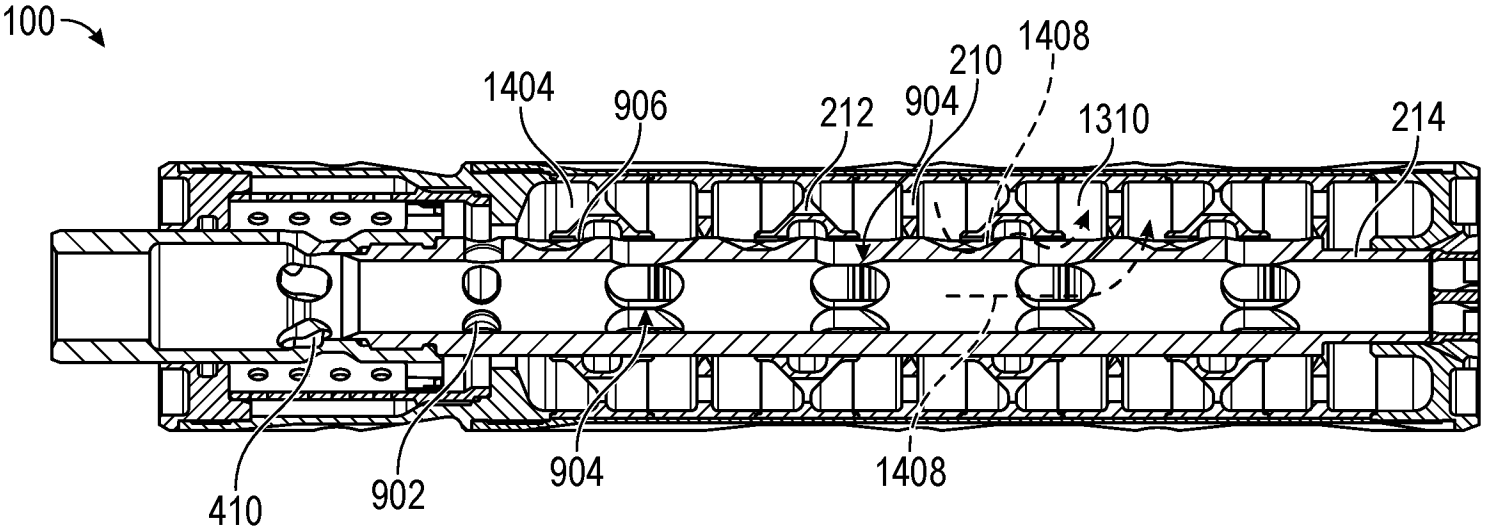
Figure 14E:
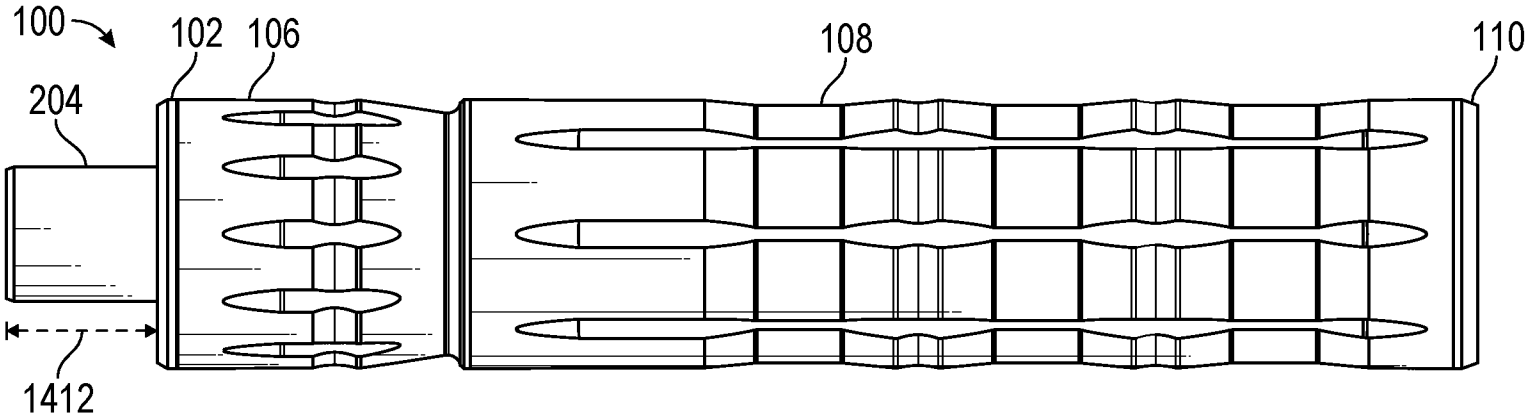
Figure 14F:
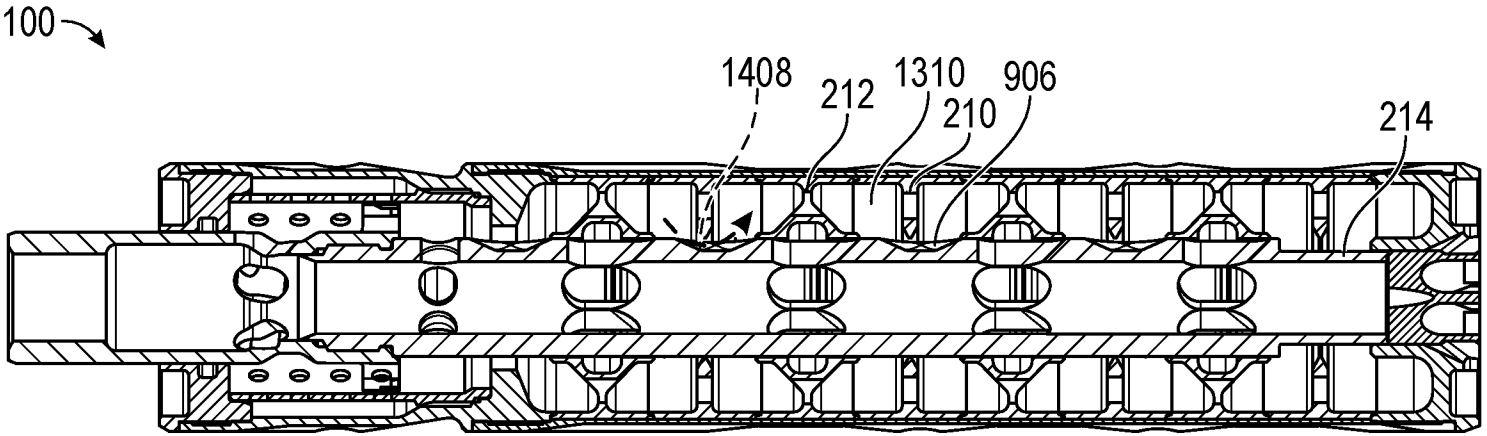

The suppressor 100 may be oriented in various positions, including a first position (illustrated in FIGS. 14A-14B), an intermediate position (illustrated in FIGS. 14C-14D), and/or a second position (illustrated in FIGS. 14E-14F). The orientation of the suppressor 100 in the first position, the intermediate position, or the second position may be caused by axially biasing the main can 104 (which may include the boost housing 106, the main housing 108, and/or the baffle structure including the first baffle(s) 210 and/or the second baffle(s) 212) with respect to the core 112 (which may include the boost core 204, the valve core 214, and/or the boost sleeve 206), thereby facilitating a valve action of the suppressor 100 that controls the flow and/or meters the egress of the volume of gas via the channel 216.

The axial biasing of the main can 104 with respect to the core 112 may be facilitated by a spring, such as the spring 202. Although not shown in FIGS. 14A-14D, it will be understood by those having ordinary skill in the art that the spring 202 may be engaged and compressed, for example, between the mounting cap 102 and the radial extrusion(s) 408 of the boost core 204 at various degrees of compression or expansion based on the relative position of the boost core 204 with respect to the mounting cap 102. The axial biasing may occur responsive to one or more actuating events based on, for example, the general and/or operational cycling type of the firearm from which the round is discharged. In some embodiments, for example, the spring 202 may be configured to axially bias the main can 104 with respect to the core 112 responsive, at least in part, to a recoil produced by the discharge of the firearm. In other embodiments, the spring may be configured to axially bias the main can 104 with respect to the core 112 responsive, at least in part, to a change in gaseous pressure produced by the discharge of the firearm.

In various embodiments, the various positions in which the suppressor 100 may be oriented may be defined, for example, by a distance with which the mounting cap 102 is biased with respect to the boost core 204. For example, in the present embodiment, the mounting cap 102 is biased with respect to the boost core 204 by distance 1402 in the first position, by distance 1410 in the intermediate position, and by distance 1412 in the second position. As illustrated in FIGS. 14A, 14C, and 14E, respectively, the distance 1402, the distance 1410, and the distance 1412 may differ with respect to one another.

The suppressor 100 may be configured with one or more holes disposed along the boost core 204, the boost sleeve 206, and/or the valve core 214. The boost core 204 may include one or more radially disposed hole(s) 410 that may be configured to facilitate the flow of the volume of gas through and into the channel 608 of the boost housing 106. The valve core may include one or more radially disposed hole(s) 902 and/or hole(s) 904, as well as one or more radially disposed indent(s) 906 along an external surface of the valve core 214, the configuration of which may further facilitate the flow of the volume of gas about the core and/or the main can.

The first baffle(s) 210 and/or the second baffle(s) 212 may be configured such that one or more chamber(s) are formed. For example, the present embodiment may include chamber(s) 1310 and chamber(s) 1404, both of which may be formed by a configuration of the first baffle(s) 210 with respect to one another and further with respect to the second baffle(s) 212. One or more bore(s) (e.g., bore(s) 702 of the first baffle(s) 210 and/or bore(s) 804 of the second baffle(s) 212) may be radially disposed within the chamber(s) 1310 and/or the chamber(s) 1404 to allow a limited flow of the volume of gas from one chamber to the next, regardless of the current position of the suppressor 100.

The flow of the volume of gas is illustrated in the present embodiment by flow 1408. Depending on whether the suppressor 100 is oriented in the first position, the intermediate position, or the second position, the flow 1408 may follow one or more different pathways through the various channels, holes, bores, and/or chambers defined by the various components of the suppressor 100. For example, in the present embodiment, the hole(s) 902 may be configured to facilitate flow 1408 into one of the chamber(s) 1404. The hole(s) 904 may be configured to facilitate the flow 1408 into the chamber(s) 1310. The chamber(s) 1310 may be configured to receive the flow 1408 from the valve core 214 through the hole(s) 904.

The flow 1408 may cause torsional and/or axial force to be applied to various components of the suppressor (e.g., torsional force to the valve core 214 and/or axial force to the first baffle(s) 210 and/or the second baffle(s) 212), which may cause the suppressor 100 to be oriented in, for example, the first position, the intermediate position, or the second position. It should be noted that, instead of being gas-based, the orientation of the suppressor may alternatively be inertia-based (e.g., responsive to a recoil caused by discharging the firearm).

Regardless of the particular manner in which the suppressor 100 comes to be oriented in the various positions, the flow 1408 may differ based on the current position. For example, in the first position, the flow 1408 may be directed into the chamber(s) 1310 and/or the chamber(s) 1404. In the intermediate position, the flow 1408 may be able to partially escape the chamber(s) 1310 and/or the chamber(s) 1404, as the indent(s) 906 may be positioned to allow partial passage of the flow 1408 from one of chamber(s) 1310 or chamber(s) 1404 to the next. The hole(s) 902 and/or the hole(s) 904 may continue to allow flow 1408 into the chamber(s) 1310 and/or the chamber(s) 1404. In the second position, the hole(s) 902 and/or the hole(s) 904 may restrict flow 1408 from entering or leaving the chamber(s) 1310 and/or the chamber(s) 1404 by aligning with a solid portion of the first baffle(s) 210 and/or the second baffle(s) 212. Over time, the flow 1408 in the chamber(s) 1310 and/or the chamber(s) 1404 may cool, which may cause the flow 1408 to reverse direction, thereby normalizing a pressure of the flow 1408 within the suppressor 100.

It again warrants mentioning that the hole(s) 410, the hole(s) 902, and the hole(s) 904 may be of any size, shape, profile, and/or orientation to control the flow of gas within the suppressor 100. In some embodiments, the various holes may be circular, but, in other embodiments, the holes may be diamond-shaped, oval-shaped, and/or teardrop-shaped, or any other suitable shape or combination of shapes to provide the desired flow 1408. In certain embodiments, the hole(s) 902 and/or the hole(s) 904 may increase or decrease in size and/or number along the length of the valve core 214. The various holes may be located in the center of the first baffle(s) 210 and/or the second baffle(s) 212, or formed from a combination of the first baffle(s) 210 and/or the second baffle(s) 212, or offset from the center of either the first baffle(s) 210 and/or the second baffle(s) 212 to control the flow 1408 in a desired manner. The timing with which the suppressor 100 changes orientation may be controlled by variables such as the size(s), shape(s), number, orientation(s), and/or distribution of the hole(s) 902 and/or the hole(s) 904, as well as their alignment(s) relative to the first baffle(s) 210 and/or the second baffle(s) 212 as the valve core 214 experiences the axial biasing described herein. By defining the sizes, shapes, and/or locations of the hole(s) 902 and/or the hole(s) 904 relative to the first baffle(s) 210 and/or the second baffle(s) 212, the suppressor 100 may allow more or less of the flow 1408 from the valve core 214 into the first baffle(s) 210 and/or the second baffle(s) 212, which may affect the speed of reorientation and/or performance of the suppressor 100.

Further, or alternatively, the spring 202 may be replaced with a different spring having different characteristics to adjust the timing of the suppressor 100. Different calibers of rounds and/or different types of ammunition may be accommodated by the size(s), shape(s), and/or orientation of the hole(s) 902 and/or the hole(s) 904 relative to the first baffle(s) 210 and/or the second baffle(s) 212. For example, in some embodiments, the valve core 214 may be the only component of the suppressor 100 that must be replaced when switching from a .45 caliber round to a 9 mm round, such that the suppressor 199 may operate at an acceptable pressure. It will, of course, be understood by those having ordinary skill in the art that numerous other modifications, alterations, and/or assemblies of the suppressor 100 are envisioned by the present disclosure, many of which may provide for further customization of the suppressor 100 in the field.

In various embodiments, the transition of the suppressor 100 between the first position, the intermediate position, and/or the second position may prove beneficial for numerous reasons. For one, controlling the otherwise rapid expansion of gas and subsequent egress from a muzzle end of a firearm following discharge of the firearm may dampen a noise produced by the discharge. Moreover, metering the flow of gas may serve to lessen a recoil felt immediately following the discharge of the firearm. Further still, the travel of various components of the suppressor 100 between the first position, the intermediate position, and/or the second position may cause a shearing effect within the suppressor 100, which may clean or remove grime, residue, dirt, or carbon from the faces of the various components of the suppressor 100.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A suppressor apparatus, comprising:

a core, defining a first channel that intersects a radially disposed hole configuration, the core configured to be coupled to a firearm, the core comprising:

a boost core; and a valve core, rigidly and removably coupled to the boost core, defining a fifth channel that intersects a third set of radially disposed holes;

a main can, disposed around the core, comprising a baffle structure, the baffle structure comprising a plurality of baffles that define a second channel and a plurality of chambers intersecting the second channel, at least a portion of the valve core configured to be disposed within the baffle structure; and a spring, coupled to the core, configured to axially bias the main can, responsive to a discharge of the firearm, between a first position and a second position with respect to the core, wherein the first position defines a first pathway through at least a portion of at least two of the first channel, the second channel, or the plurality of chambers via the hole configuration, wherein the second position defines a second pathway, different from the first pathway, through at least a portion of at least two of the first channel, the second channel, or the plurality of chambers via the hole configuration, and wherein the suppressor apparatus is configured to control a flow of a volume of gas, produced by the discharge of the firearm, via the first pathway or the second pathway based on whether the main can is axially biased in the first position or the second position with respect to the core.

2. The suppressor apparatus of claim 1, wherein the core further comprises:

a boost sleeve, disposed around and movably engaged with the boost core, defining a fourth channel that intersects a second set of radially disposed holes, wherein the boost core defines a third channel that intersects a first set of radially disposed holes, the boost core comprising one or more radial extrusions, wherein the spring is disposed between the boost core and the boost sleeve and engaged against the one or more radial extrusions, wherein the hole configuration comprises the first set of radially disposed holes, the second set of radially disposed holes, and the third set of radially disposed holes, wherein the first channel comprises the third channel and the fifth channel, wherein the first pathway includes at least a portion of the fourth channel, and wherein the second pathway includes at least a portion of the fourth channel.

3. The suppressor apparatus of claim 2, wherein at least one of the first set of radially disposed holes, the second set of radially disposed holes, and the third set of radially disposed holes comprise at least a first hole type and a second hole type different from the first hole type.

4. The suppressor apparatus of claim 2, wherein at least one of the first set of radially disposed holes, the second set of radially disposed holes, and the third set of radially disposed holes comprise one or more holes having a circular, diamond, oval, and/or teardrop profile.

5. The suppressor apparatus of claim 1, wherein the valve core comprises a set of radially disposed indents, wherein the first position further defines the first pathway around the set of radially disposed indents, and wherein the second position further defines the second pathway around the set of radially disposed indents.

6. The suppressor apparatus of claim 2, further comprising a mounting cap, rigidly coupled to the boost core, wherein the spring is engaged between the mounting cap and the one or more radial extrusions of the boost core.

7. The suppressor apparatus of claim 2, wherein the main can comprises a boost housing rigidly coupled to a main housing, the boost housing disposed around at least a portion of the boost core, the boost sleeve, and the spring, and the main housing disposed around the baffle structure.

8. The suppressor apparatus of claim 1, wherein the plurality of baffles comprise at least a first baffle having a first baffle configuration and a second baffle, rigidly coupled to the first baffle, having a second baffle configuration different from the first baffle configuration.

9. The suppressor apparatus of claim 8, wherein the first baffle configuration comprises a first set of bores and one or more first chambers, wherein the second baffle configuration comprises a second set of bores and one or more second chambers, and wherein the plurality of chambers comprises the one or more first chambers, the one or more second chambers, and/or one or more third chambers formed by mating the one or more first chambers with each other and/or with the one or more second chambers.

10. The suppressor apparatus of claim 8, wherein the plurality of baffles further comprise a third baffle, rigidly coupled to the first baffle and/or the second baffle, having a third baffle configuration different from the first baffle configuration and/or the second baffle configuration.

11. The suppressor apparatus of claim 8, wherein the plurality of baffles are configured to be oriented interchangeably with respect to one another.

12. The suppressor apparatus of claim 1, further comprising a discharge cap, rigidly coupled to the main can, defining a radial aperture profile that controls an egress of the volume of gas from the suppressor apparatus.

13. The suppressor system of claim 1, further comprising an O-ring or gasket, disposed around the core, the O-ring or gasket configured to form an airtight seal between the core and an external environment.

14. The suppressor apparatus of claim 1, wherein the spring is further configured to axially bias the main can with respect to the core responsive, at least in part, to a recoil produced by the discharge of the firearm.

15. The suppressor apparatus of claim 1, wherein the spring is further configured to axially bias the main can with respect to the core responsive, at least in part, to a change in gaseous pressure produced by the discharge of the firearm.

16. The suppressor apparatus of claim 1, wherein the firearm is one of a handgun, a long gun, or a shotgun and further one of a blowback-operated firearm, a gas-operated firearm, or a recoil-operated firearm.

17. A suppressor system, comprising:

a mounting cap;

a boost core, configured to be rigidly coupled to the mounting cap, defining a first channel that intersects a first set of radially disposed holes, and comprising one or more radial extrusions;

a spring, disposable around the boost core, configured to engage between the mounting cap and the one or more radial extrusions of the boost core, a boost sleeve, disposable around the boost core and the spring, configured to be movably engaged with the boost core, and defining a second channel that intersects a second set of radially disposed holes;

a valve core, configured to be rigidly and removably coupled to the boost core, defining a third channel that intersects a third set of radially disposed holes, and comprising a set of radially disposed indents;

a main can, disposable around the boost core, the spring, the boost sleeve, and the valve core;

a baffle structure, disposable within and configured to be rigidly coupled to the main can, comprising a plurality of baffles that define a fourth channel and a plurality of chambers intersecting the fourth channel, at least a portion of the valve core configured to be disposed within the baffle structure;

a discharge cap, configured to be rigidly coupled to the main can, defining a radial aperture profile, wherein the boost core is configured to be rigidly coupled to a firearm, wherein the spring is further configured to axially bias the main can and the baffle structure, responsive to a discharge of the firearm, between a first position and a second position with respect to the boost core, the boost sleeve, and the valve core, wherein the first position defines a first pathway through at least a portion of at least two of the first channel, the second channel, the third channel, the fourth channel, or the plurality of chambers, the first pathway extending around the set of radially disposed indents via at least one of the first set of radially disposed holes, the second set of radially disposed holes, or the third set of radially disposed holes, wherein the second position defines a second pathway, different from the first pathway, through at least a portion of at least two of the first channel, the second channel, the third channel, the fourth channel, or the plurality of chambers, the second pathway extending around the set of radially disposed indents via at least one of the first set of radially disposed holes, the second set of radially disposed holes, or the third set of radially disposed holes, wherein the suppressor system is configured to control a flow of a volume of gas, produced by the discharge of the firearm, via the first pathway or the second pathway based on whether the main can and the baffle structure are axially biased in the first position or the second position with respect to the boost core, the boost sleeve, and the valve core, and wherein the radial aperture profile of the discharge cap is configured to control an egress of the volume of gas from the suppressor system.

18. The suppressor system of claim 17, wherein the main can comprises a boost housing and a main housing configured to be rigidly coupled to each other, the boost housing disposable around at least a portion of the boost core, the boost sleeve, and the spring, and the main housing disposable around the baffle structure, wherein at least one of the first set of radially disposed holes, the second set of radially disposed holes, and the third set of radially disposed holes comprise at least a first hole type and a second hole type different from the first hole type, wherein the plurality of baffles comprises at least a first baffle having a first baffle configuration comprising a first set of bores and one or more first chambers and a second baffle having a second baffle configuration, different from the first baffle configuration, comprising a second set of bores and one or more second chambers, the plurality of baffles configured to be rigidly and interchangeably coupled to one another, and wherein the plurality of chambers comprises the one or more first chambers, the one or more second chambers, and/or one or more third chambers formed by mating the one or more first chambers with each other and/or with the one or more second chambers.

19. A core assembly for use with a suppressor system, the core assembly comprising:

a boost core, configured to be rigidly coupled to a mounting cap, the boost core defining a first channel that intersects a first set of radially disposed holes, the boost core comprising one or more radial extrusions configured to engage with a spring, the spring disposable around the boost core and configured to further engage with the mounting cap;

a boost sleeve, disposable around the boost core and the spring, the boost sleeve configured to be movably engaged with the boost core, the boost sleeve defining a second channel that intersects a second set of radially disposed holes; and a valve core, configured to be rigidly and removably coupled to the boost core, the valve core defining a third channel that intersects a third set of radially disposed holes, the valve core comprising a set of radially disposed indents, wherein the boost core, the spring, the boost sleeve, and the valve core are configured to be disposed within a main can of the suppressor system, wherein a baffle structure is disposable within and configured to be rigidly coupled to the main can, the baffle structure comprising a plurality of baffles that define a fourth channel and a plurality of chambers intersecting the fourth channel, at least a portion of the valve core configured to be disposed within the baffle structure, wherein the boost core is configured to be rigidly coupled to a firearm, wherein the spring is further configured to axially bias the main can and the baffle structure, responsive to a discharge of the firearm, between a first position and a second position with respect to the boost core, the boost sleeve, and the valve core, wherein the first position defines a first pathway through at least a portion of at least two of the first channel, the second channel, the third channel, the fourth channel, or the plurality of chambers, the first pathway extending around the set of radially disposed indents via at least one of the first set of radially disposed holes, the second set of radially disposed holes, or the third set of radially disposed holes, and wherein the second position defines a second pathway, different from the first pathway, through at least a portion of at least two of the first channel, the second channel, the third channel, the fourth channel, or the plurality of chambers, the second pathway extending around the set of radially disposed indents via at least one of the first set of radially disposed holes, the second set of radially disposed holes, or the third set of radially disposed holes.

20. The core assembly of claim 19, wherein the suppressor system further comprises a discharge cap, configured to be rigidly coupled to the main can, the discharge cap defining a radial aperture profile, wherein the suppressor system is configured to control a flow of a volume of gas, produced by the discharge of the firearm, via the first pathway or the second pathway based on whether the main can and the baffle structure are axially biased in the first position or the second position with respect to the boost core, the boost sleeve, and the valve core, and wherein the radial aperture profile of the discharge cap is configured to control an egress of the volume of gas from the suppressor system.

* * * * *